US010733950B2

(12) United States Patent
Hwang et al.

(10) Patent No.: US 10,733,950 B2
(45) Date of Patent: Aug. 4, 2020

(54) GATE DRIVING CIRCUIT AND DISPLAY DEVICE INCLUDING THE SAME

(71) Applicant: Samsung Display Co., Ltd., Yongin-si, Gyeonggi-do (KR)

(72) Inventors: Junghwan Hwang, Cheonan-si (KR); Sehyoung Cho, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/518,710

(22) Filed: Jul. 22, 2019

(65) Prior Publication Data

US 2019/0340991 A1 Nov. 7, 2019

Related U.S. Application Data

(63) Continuation of application No. 15/227,924, filed on Aug. 3, 2016, now Pat. No. 10,360,863.

(30) Foreign Application Priority Data

Oct. 14, 2015 (KR) ..... 10-2015-0143568
Jan. 25, 2016 (KR) ..... 10-2016-0008893

(51) Int. Cl.
*G09G 3/36* (2006.01)

(52) U.S. Cl.
CPC ..... *G09G 3/3677* (2013.01); *G09G 3/3648* (2013.01); *G09G 3/3696* (2013.01); *G09G 2310/0286* (2013.01)

(58) Field of Classification Search
CPC ..... G09G 3/3696; G09G 3/36; G09G 3/3677; G09G 3/3648
USPC ..... 345/87, 211, 212, 213
See application file for complete search history.

(56) References Cited

U.S. PATENT DOCUMENTS

| | | | |
|---|---|---|---|
| 2010/0097368 | A1 | 4/2010 | Hwang |
| 2013/0141318 | A1 | 6/2013 | Kim et al. |
| 2014/0055436 | A1 | 2/2014 | Han et al. |
| 2014/0118324 | A1 | 5/2014 | Chan et al. |
| 2014/0267214 | A1 | 9/2014 | Hwang et al. |
| 2016/0322015 | A1 | 11/2016 | Kim et al. |

FOREIGN PATENT DOCUMENTS

| | | | |
|---|---|---|---|
| KR | 10-1327858 | A | 11/2013 |
| KR | 10-2013-0142454 | A | 12/2013 |
| KR | 10-2014-0025794 | A | 3/2014 |
| KR | 10-2014-0094882 | A | 7/2014 |
| KR | 10-2014-0112290 | A | 9/2014 |
| KR | 10-2014-0134532 | A | 11/2014 |
| KR | 10-2016-130076 | A | 11/2016 |

*Primary Examiner* — Abdul-Samad A Adediran
(74) *Attorney, Agent, or Firm* — Lewis Roca Rothgerber Christie LLP

(57) ABSTRACT

A gate driving circuit includes: a plurality of stages to provide gate signals to gate lines of a display panel, a k-th stage, where k is a natural number greater than or equal to 2, from among the plurality of stages being configured: to receive a clock signal, a (k−1)th carry signal from a (k−1)th stage, a (k+1)th carry signal from a (k+1)th stage, a (k+2)th carry signal from a (k+2)th stage, a first voltage, and a second voltage, the clock signal being a pulse signal in which a high voltage and a third voltage appear periodically, and the third voltage having a lower voltage level than those of the first voltage and the second voltage; and to output a k-th gate signal and a k-th carry signal.

20 Claims, 19 Drawing Sheets

GATE DRIVING CIRCUIT AND DISPLAY DEVICE INCLUDING THE SAME

CROSS-REFERENCE TO RELATED APPLICATION

This application is a continuation of U.S. patent application Ser. No. 15/227,924, filed on Aug. 3, 2016, which claims priority to, and the benefit of, Korean Patent Application Nos. 10-2015-0143568, filed on Oct. 14, 2015, and 10-2016-0008893, filed on Jan. 25, 2016, in the Korean Intellectual Property Office (KIPO), the entire contents of all of which are incorporated herein by reference.

BACKGROUND

1. Field

One or more aspects of example embodiments of the present disclosure relate to a gate driving circuit and a display device including the same.

2. Description of the Related Art

A display device includes a plurality of gate lines, a plurality of data lines, and a plurality of pixels respectively connected to the plurality of gate lines and the plurality of data lines. The display device includes a gate driving circuit for sequentially providing gate signals to the plurality of gate lines, and includes a data driving circuit for outputting data signals to the plurality of data lines.

The gate driving circuit includes a shift register with a plurality of driving circuits (hereinafter referred to as driving stages). The plurality of driving stages respectively output gate signals corresponding to the plurality of gate lines. Each of the plurality of driving stages includes a plurality of connected (e.g., operatively-connected) transistors.

When frequencies of gate signals outputted from the gate driving circuit are the same, as the size of a display panel becomes larger, the first horizontal period becomes longer. As the first horizontal period becomes longer, gate signal delay occurs and may cause deterioration of a display image.

The above information disclosed in this Background section is for enhancement of understanding of the background of the inventive concept, and therefore, it may contain information that does not constitute prior art.

SUMMARY

One or more aspects of example embodiments of the present disclosure provide a reliability improved gate driving circuit, and a display device including the reliability improved gate driving circuit.

According to an example embodiment of the inventive concept, a gate driving circuit includes: a plurality of stages configured to provide gate signals to gate lines of a display panel, a k-th stage, where k is a natural number greater than or equal to 2, from among the plurality of stages being configured: to receive a clock signal, a (k−1)th carry signal from a (k−1)th stage, a (k+1)th carry signal from a (k+1)th stage, a (k+2)th carry signal from a (k+2)th stage, a first voltage, and a second voltage, the clock signal being a pulse signal in which a high voltage and a third voltage appear periodically, and the third voltage having a lower voltage level than those of the first voltage and the second voltage; and to output a k-th gate signal and a k-th carry signal.

In an embodiment, the k-th stage may include a first output unit configured: to output the high voltage of the clock signal as the k-th gate signal in response to a signal of a first node during a k-th clock period; and to discharge the k-th gate signal as the third voltage of the clock signal in response to the signal of the first node during a (k+1)th clock period.

In an embodiment, the k-th stage may further include a second output unit configured to output the clock signal as the k-th carry signal in response to the signal of the first node.

In an embodiment, the k-th stage may further include a first pull-down unit configured to discharge the k-th gate signal as the first voltage in response to the (k+1)th carry signal.

In an embodiment, the k-th stage may include: a control unit configured to provide one of the clock signal and the second voltage to a first node in response to the clock signal, the (k−1)th carry signal, and the (k+1)th carry signal; an inverter unit configured to provide the clock signal to a second node; a first discharge unit configured to discharge the second node to the second voltage in response to the (k−1)th carry signal; a second discharge unit configured to discharge the k-th carry signal as the second voltage in response to a signal of the second node; and a third discharge unit configured to discharge the k-th gate signal as the first voltage in response to the signal of the second node.

In an embodiment, the k-th stage may further include a second pull-down unit configured to discharge the k-th carry signal as the second voltage in response to the (k+1)th carry signal.

In an embodiment, the first voltage and the second voltage may have different voltage levels.

In an embodiment, the k-th stage may include: a control unit configured to provide one of the clock signal and the second voltage to the first node in response to the clock signal, the (k−1)th carry signal, and the (k+1)th carry signal; an inverter unit configured to provide the clock signal to a second node; a first discharge unit configured to discharge the first node and the second node to the second voltage in response to the (k−1)th carry signal; a second discharge unit configured to discharge the k-th carry signal as the second voltage in response to a signal of the second node; a third discharge unit configured to discharge the k-th gate signal as the first voltage in response to the signal of the second node; and a second pull-down unit configured to discharge the k-th carry signal as the second voltage in response to the (k+2)th carry signal.

In an embodiment, the k-th stage may further include: a fourth discharge unit configured to discharge the first node to the second voltage in response to the (k+2)th carry signal; and a first pull-down unit configured to discharge the k-th gate signal as the second voltage in response to the (k+2)th carry signal.

In an embodiment, the fourth discharge unit may include: a first discharge transistor connected between the first node and a fourth node, and including a control electrode connected to the (k+2)th carry signal; and a second discharge transistor connected between the fourth node and the second voltage, and including a control electrode connected to the fourth node.

According to an example embodiment of the inventive concept, a display device includes: a display panel including a plurality of pixels respectively connected to a plurality of gate lines and a plurality of data lines; a gate driving circuit including a plurality of stages configured to output gate signals to the plurality of gate lines; and a data driving circuit configured to drive the plurality of data lines, a k-th stage, where k is a natural number greater than or equal to 2, from among the plurality of stages being configured: to receive a clock signal, a (k−1)th carry signal from a (k−1)th stage, a (k+1)th carry signal from a (k+1)th stage, a (k+2)th carry signal from a (k+2)th stage, a first voltage, and a second voltage, the clock signal being a pulse signal in which a high voltage and a third voltage appear periodically, and the third voltage having a lower voltage level than those of the first voltage and the second voltage; and to output a k-th gate signal and a k-th carry signal.

In an embodiment, the display panel may include: a display area where the plurality of pixels are arranged; and a non-display area adjacent to the display area, the gate driving circuit being integrated in the non-display area.

In an embodiment, the k-th stage may include a first output unit configured: to output the high voltage of the clock signal as the k-th gate signal in response to a signal of a first node during a k-th clock period; and to discharge the k-th gate signal as the third voltage of the clock signal in response to the signal of the first node during a (k+1)th clock period.

In an embodiment, the k-th stage may further include a second output unit configured to output the clock signal as the k-th carry signal in response to the signal of the first node.

In an embodiment, the k-th stage may further include a first pull-down unit configured to discharge the k-th gate signal as the first voltage in response to the (k+1)th carry signal.

In an embodiment, the k-th stage may include: a control unit configured to provide one of the clock signal and the second voltage to the first node in response to the clock signal, the (k−1)th carry signal, and the (k+1)th carry signal; an inverter unit configured to provide the clock signal to a second node; a first discharge unit configured to discharge the second node to the second voltage in response to the (k−1)th carry signal; a second discharge unit configured to discharge the k-th carry signal as the second voltage in response to a signal of the second node; and a third discharge unit configured to discharge the k-th gate signal as the first voltage in response to the signal of the second node.

In an embodiment, the k-th stage may further include a second pull-down unit configured to discharge the k-th carry signal as the second voltage in response to the (k+1)th carry signal.

In an embodiment, display device may further include a driving controller configured to control the gate driving circuit and the data driving circuit in response to a control signal and an image signal provided from an outside, and to generate the clock signal, the first voltage, the second voltage, and the third voltage.

In an embodiment, pulses of the clock signal may correspond to the plurality of gate lines, respectively, and a voltage level of the third voltage of each of the pulses of the clock signal may correspond to an order of the pulse in one frame.

In an embodiment, the gate signals may be outputted sequentially in an order from a first stage from among the plurality of stages closer to the driving controller to a last stage from among the plurality of stages farther from the driving controller, and a voltage level of the third voltage of each of the pulses of the clock signal may be gradually lowered according to an order of the pulse in the one frame.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept, and together with the description, serve to explain aspects and features of the inventive concept. In the drawings.

DETAILED DESCRIPTION

Figure 1:
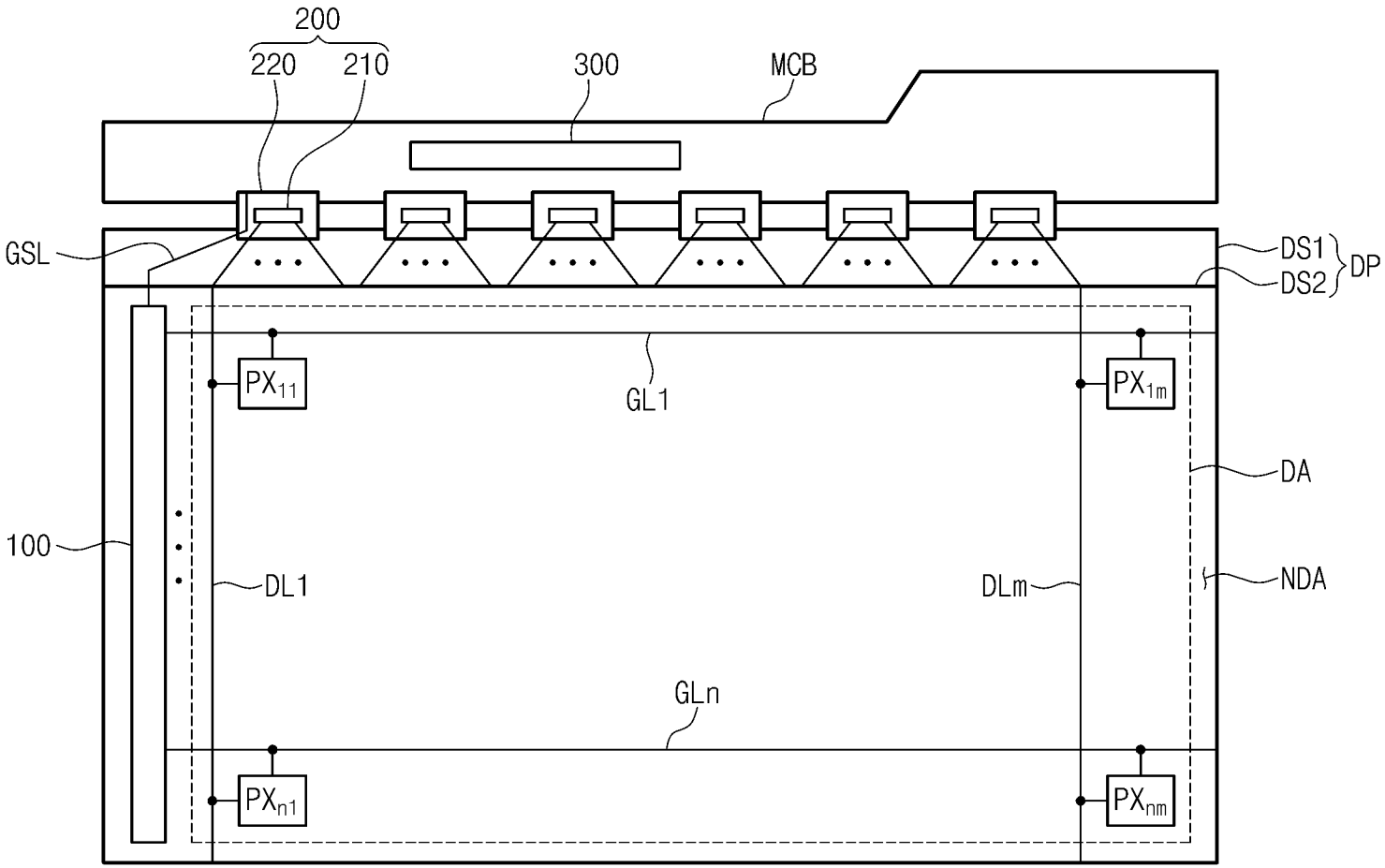
FIG. 1 is a plan view of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
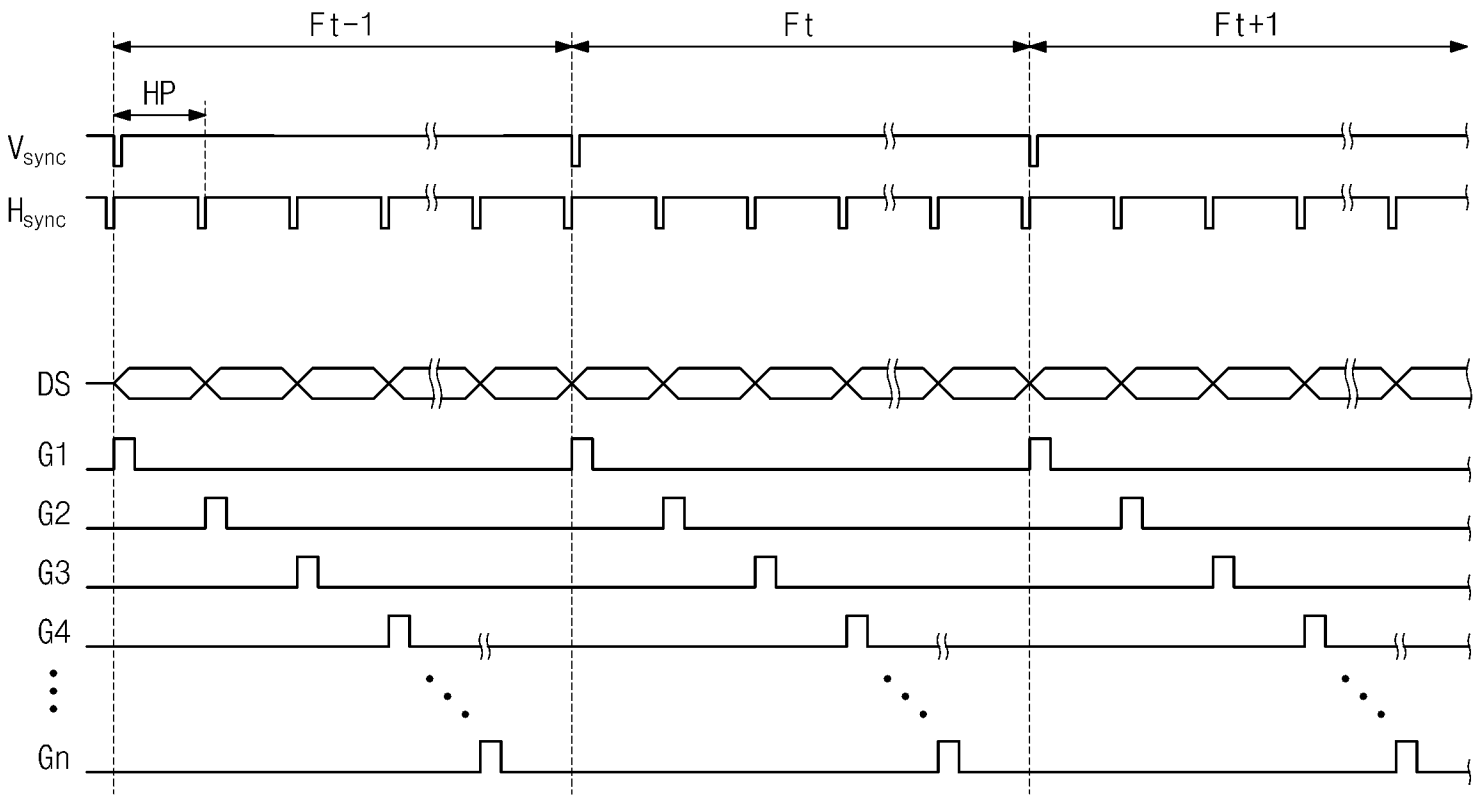
FIG. 2 is a timing diagram illustrating signals of a display device according to an embodiment of the inventive concept.

FIG. 1 is a plan view of a display device according to an embodiment of the inventive concept. FIG. 2 is a timing diagram illustrating signals of a display device according to an embodiment of the inventive concept.

As shown in FIGS. 1 and 2, a display device according to an embodiment of the inventive concept includes a display panel DP, a gate driving circuit 100, a data driving circuit 200, and a driving controller 300.

While the display panel DP is described as a liquid crystal display panel, the display panel DP is not limited thereto, for example, the display panel DP may include various display panels, such as a liquid crystal display panel, an organic light emitting display panel, an electrophoretic display panel, and/or an electrowetting display panel. On the other hand, a liquid crystal display device including a liquid crystal display panel may further include a polarizer and a backlight unit (e.g., a backlight source).

The display panel DP includes a first substrate DS1, a second substrate DS2 spaced from the first substrate DS1, and a liquid crystal layer LCL between the first substrate DS1 and the second substrate DS2. On a plane, the display panel DP includes a display area DA including a plurality of pixels PX11 to PXnm, and a non-display area NDA surrounding the display area DA.

The display panel DP includes a plurality of gate lines GL1 to GLn disposed on the first substrate DS1, and a plurality of data lines DL1 to DLm crossing the plurality of gate lines GL1 to GLn. The plurality of gate lines GL1 to GLn are connected to the gate driving circuit 100. The plurality of data lines DL1 to DLm are connected to the data driving circuit 200. For convenience, some of the plurality of gate lines GL1 to GLn and some of the plurality of data lines DL1 to DLm are illustrated in FIG. 1.

Further, some of the plurality of pixels PX11 to PXnm are illustrated in FIG. 1. The plurality of pixels PX11 to PXnm are respectively connected to corresponding gate lines from among the plurality of gate lines GL1 to GLn and corresponding data lines from among the plurality of data lines DL1 to DLm.

The plurality of pixels PX11 to PXnm may be divided into a plurality of groups according to a color to be displayed. Each of the plurality of pixels PX11 to PXnm may display one of primary colors. The primary colors may include red, green, blue, and white. However, the inventive concept is not limited thereto, and thus, the primary colors may further include (or alternatively include) various colors, such as yellow, cyan, magenta, etc.

The gate driving circuit 100 and the data driving circuit 200 receive control signals from the driving controller 300. The driving controller 300 may be mounted on a main circuit board MCB. The driving controller 300 receives image data and control signals from an external graphic control unit (e.g., an external graphic controller). The control signals may include vertical sync signals Vsync that are signals for distinguishing frame sections Ft−1, Ft, and Ft+1, horizontal sync signals Hsync that are signals for distinguishing horizontal sections HP (e.g., row distinction signals), data enable signals (e.g., high level signals during a section where data is outputted to display a data incoming area), and clock signals.

The gate driving circuit 100 generates gate signals G1 to Gn based on a control signal (hereinafter referred to as a gate control signal) received from the driving controller 300 through a signal line GSL, and outputs the gate signals G1 to Gn to the plurality of gate lines GL1 to GLn, during each of the frame sections Ft−1, Ft, and Ft+1. The gate signals G1 to Gn may be sequentially outputted corresponding to the horizontal sections HP. The gate driving circuit 100 and the pixels PX11 to PXnm may be formed concurrently (e.g., simultaneously) through a thin film process. For example, the gate driving circuit 100 may be mounted as an Oxide Semiconductor TFT Gate driver circuit (OSG) at the non-display area NDA.

FIG. 1 illustrates one gate driving circuit 100 connected to left ends of the plurality of gate lines GL1 to GLn. However, the inventive concept is not limited thereto, for example, in some embodiments, a display device may include two gate driving circuits. One of the two gate driving circuits may be connected to the left ends of the plurality of gate lines GL1 to GLn, and the other one may be connected to right ends of the plurality of gate lines GL1 to GLn. In some embodiments, one of the two gate driving circuits may be connected to odd gate lines and the other one may be connected to even gate lines.

The data driving circuit 200 generates grayscale (e.g., gray level) voltages according to image data provided from the driving controller 300 based on a control signal (hereinafter referred to as a data control signal) received from the driving controller 300. The data driving circuit 200 outputs the grayscale voltages as data voltages DS to the plurality of data lines DL1 to DLm.

The data voltages DS may include positive data voltages having a positive value (e.g., a positive polarity) with respect to a common voltage and/or negative data voltages having a negative value (e.g., a negative polarity) with respect to the common voltage. Some of data voltages applied to the data lines DL1 to DLm have a positive polarity and others have a negative polarity during each of the horizontal sections HP. The polarity of the data voltages DS may be inverted according to the frame sections Ft−1, Ft, and Ft+1 in order to prevent or reduce the deterioration of a liquid crystal. The data driving circuit 200 may generate data voltages inverted by each frame section unit in response to an invert signal.

The data driving circuit 200 may include a driving chip 210 and a flexible circuit board 220 on which the driving chip 210 may be mounted. The data driving circuit 200 may include a plurality of driving chips 210 and a plurality of flexible circuit boards 220. The flexible circuit board 220 electrically connects the main circuit board MCB to the first substrate DS1. The plurality of driving chips 210 provide corresponding data signals to corresponding data lines from among the plurality of data lines DL1 to DLm.

FIG. 1 illustrates a Tape Carrier Package (TCP) type (e.g., kind) of data driving circuit 200 as an example. According to another embodiment of the inventive concept, the data driving circuit 200 may be disposed on the non-display area NDA of the first substrate DS1 through a Chip on Glass (COG) method.

Figure 3:
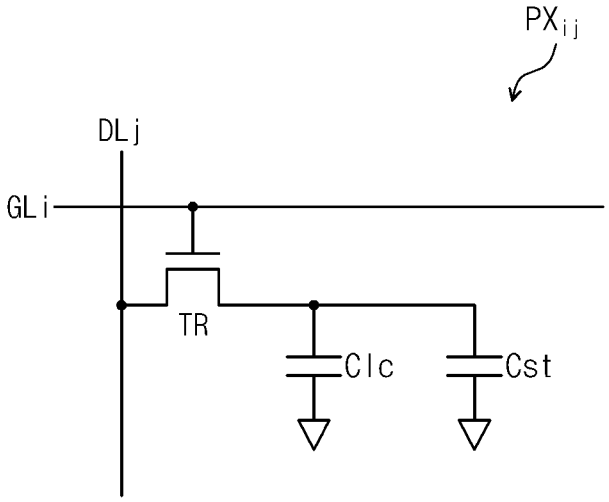
FIG. 3 is an equivalent circuit diagram of a pixel according to an embodiment of the inventive concept.
Figure 4:
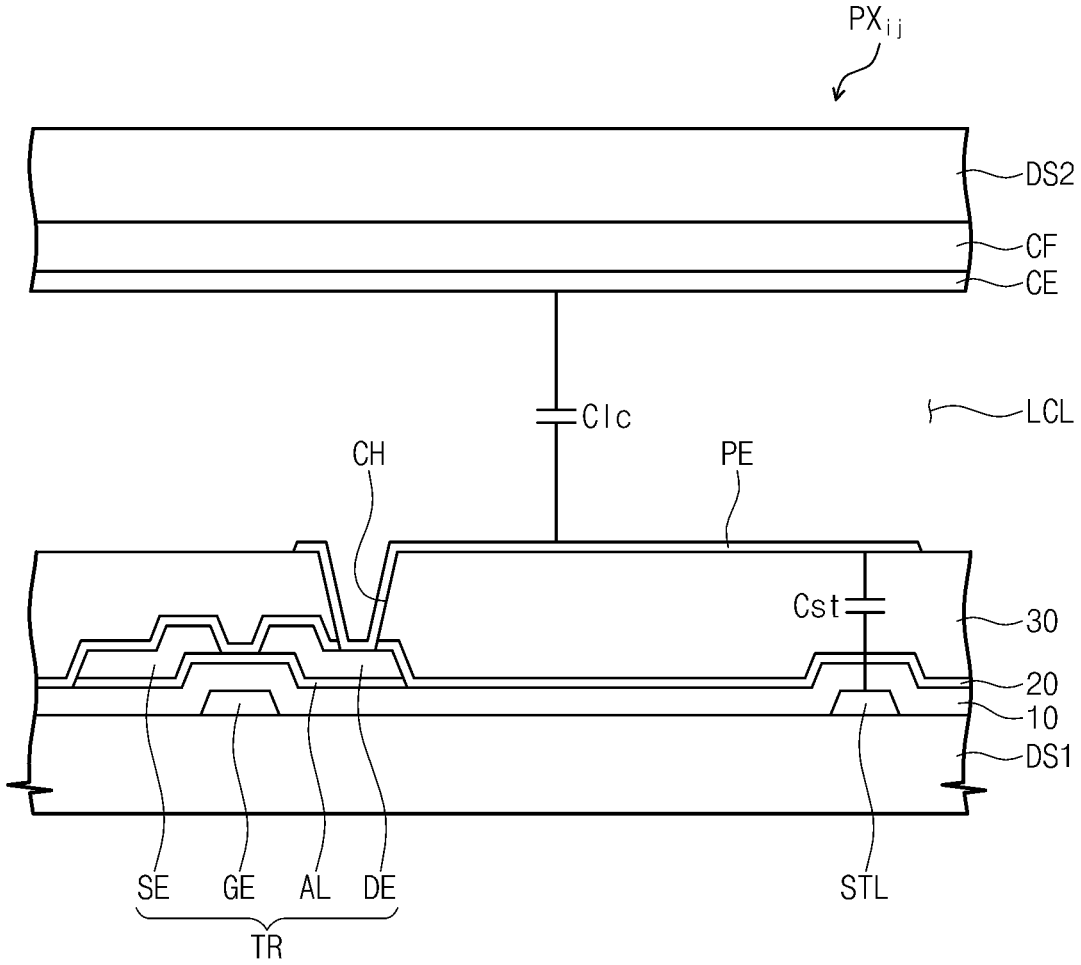
FIG. 4 is a sectional view of a pixel according to an embodiment of the inventive concept.

FIG. 3 is an equivalent circuit diagram of a pixel according to an embodiment of the inventive concept. FIG. 4 is a sectional view of a pixel according to an embodiment of the inventive concept. Each of the plurality of pixels PX11 to PXnm shown in FIG. 1 may have an equivalent or substantially equivalent circuit as that of a pixel PXij shown in FIG. 3.

As shown in FIG. 3, the pixel PXij includes a pixel thin film transistor (hereinafter referred to as a pixel transistor) TR, a liquid crystal capacitor Clc, and a storage capacitor Cst. Hereinafter, a transistor refers to a thin film transistor. According to an embodiment of the inventive concept, the storage capacitor Cst may be omitted.

The pixel transistor TR is electrically connected to an ith gate line GLi and a jth data line DLj. The pixel transistor TR outputs a pixel voltage corresponding to a data signal received from the jth data line DLj in response to a gate signal received from the ith gate line GLi.

The liquid crystal capacitor Clc is charged with the pixel voltage outputted from the pixel transistor TR. An arrangement of liquid crystal directors included in a liquid crystal layer LCL (see FIG. 4) is changed according to a charge amount charged in the liquid crystal capacitor CLc. Light incident to the liquid crystal layer LCL may be transmitted or blocked according to an arrangement of the liquid crystal directors.

The storage capacitor Cst is connected in parallel to the liquid crystal capacitor Clc. The storage capacitor Cst maintains or substantially maintains an arrangement of the liquid crystal directors of a section (e.g., a predetermined section) of the display panel DP.

As shown in FIG. 4, the pixel transistor TR includes a control electrode GE connected to the ith gate line GLi (see FIG. 3), an activation part AL overlapping the control electrode GE, a first electrode SE connected to the jth data line DLj (see FIG. 3), and a second electrode DE spaced from the first electrode SE.

The liquid crystal capacitor Clc includes a pixel electrode PE and a common electrode CE. The storage capacitor Cst includes the pixel electrode PE and a portion of a storage line STL overlapping with the pixel electrode PE.

The ith gate line GLi and the storage line STL are located on a surface (e.g., one surface) of the first substrate DS1. The control electrode GE is branched from the ith gate line GLi. The ith gate line GLi and the storage line STL may include a metal (for example, Al, Ag, Cu, Mo, Cr, Ta, Ti, etc.) or an alloy thereof. The ith gate line GLi and the storage line STL may have a multi-layer structure, and for example, may include a Ti layer and a Cu layer.

A first insulating layer 10 covering the control electrode GE and the storage line STL is disposed on the surface (e.g., the one surface) of the first substrate DS1. The first insulating layer 10 may include at least one of an inorganic material and an organic material. The first insulating layer 10 may be an organic layer or an inorganic layer. The first insulating layer 10 may have a multi-layer structure, and for example, may include a silicon nitride layer and a silicon oxide layer.

The activation part AL overlapping the control electrode GE is disposed on the first insulating layer 10. The activation part AL may include a semiconductor layer and an ohmic contact layer. The semiconductor layer is disposed on the first insulating layer 10, and the ohmic contact layer is disposed on the semiconductor layer.

The second electrode DE and the first electrode SE are disposed on the activation part AL. The second electrode DE and the first electrode SE are spaced from each other. Each of the second electrode DE and the first electrode SE partially overlaps with the control electrode GE.

A second insulating layer 20 covering the activation part AL, the second electrode DE, and the first electrode SE is disposed on the first insulating layer 10. The second insulating layer 20 may include at least one of an inorganic material and an organic material. The second insulating layer 20 may be an organic layer or an inorganic layer. The second insulating layer 20 may have a multi-layer structure, and for example, may include a silicon nitride layer and a silicon oxide layer.

Although the pixel transistor TR having a staggered structure is shown in FIG. 1 as an example, a structure of the pixel transistor TR is not limited thereto. For example, in some embodiments, the pixel transistor TR may have a planar structure.

A third insulating layer 30 is disposed on the second insulating layer 20. The third insulating layer 30 provides a flat surface. The third insulating layer 30 may include an organic material.

The pixel electrode PE is disposed on the third insulating layer 30. The pixel electrode PE is connected to the second electrode DE through a contact hole CH penetrating the second insulating layer 20 and the third insulating layer 30. In some embodiments, an alignment layer covering the pixel electrode PE may be disposed on the third insulating layer 30.

A color filter layer CF is disposed on a surface (e.g., one surface) of the second substrate DS2. The common electrode CE is disposed on the color filter layer CF. A common voltage is applied to the common electrode CE. The common voltage and the pixel voltage have different values. In some embodiments, an alignment layer covering the common electrode CE may be disposed on the common electrode CE. In some embodiments, another insulating layer may be disposed between the color filter layer CF and the common electrode CE.

The pixel electrode PE and the common electrode CE with the liquid crystal layer LCL therebetween form the liquid crystal capacitor Clc. Additionally, portions of the pixel electrode PE and the storage line STL, which are disposed with the first insulating layer 10, the second insulating layer 20, and the third insulating layer 30 therebetween, form the storage capacitor Cst. The storage line STL receives a storage voltage having a different value than the pixel voltage. The storage voltage may have the same or substantially the same value as the common voltage.

On the other hand, the section of the pixel PXij shown in FIG. 3 is just one example. In some embodiments, unlike those shown in FIG. 3, at least one of the color filter layer CF and the common electrode CE may be disposed on the first substrate DS1. That is, a liquid crystal display panel according to one or more embodiments of the inventive concept may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
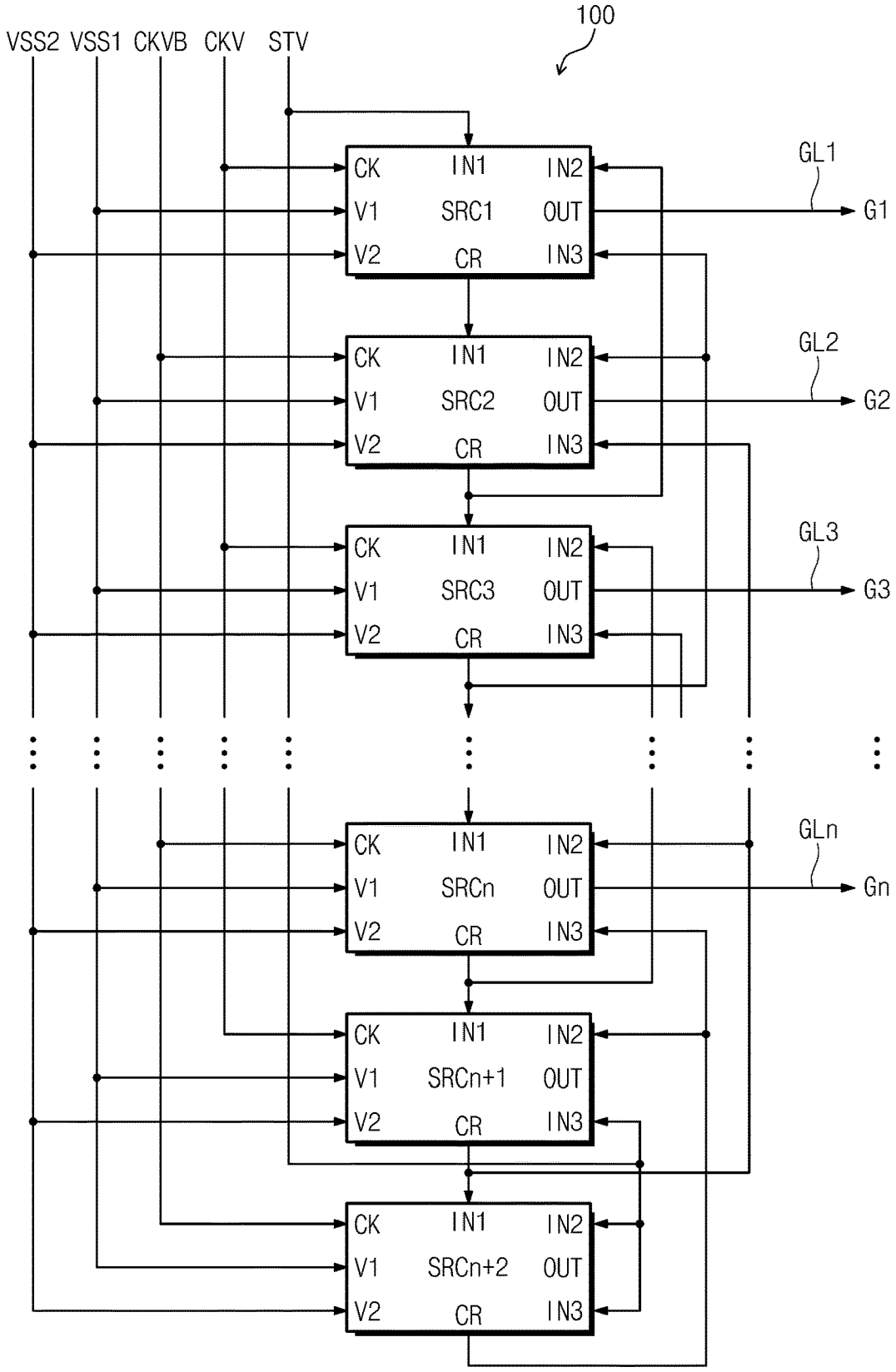
FIG. 5 is a block diagram illustrating a gate driving circuit according to an embodiment of the inventive concept.

FIG. 5 is a block diagram illustrating a gate driving circuit according to an embodiment of the inventive concept.

As shown in FIG. 5, a gate driving circuit 100 includes a plurality of driving stages SRC1 to SRCn and a plurality of dummy driving stages SRCn+1 and SRCn+2. The plurality of driving stages SRC1 to SRCn and the dummy driving stage SRCn+1 have a cascade relationship in which they operate in response to a carry signal outputted from a previous stage and a carry signal outputted from the next stage.

Each of the plurality of driving stages SRC1 to SRCn receives a first clock signal CKV or a second clock signal CKVB, and receives a first voltage (e.g., a first ground voltage or a first low voltage) VSS1 and a second voltage (e.g., a second ground voltage or a second low voltage) VSS2, from the driving controller 300 shown in FIG. 1. The driving stage (e.g., a first driving stage) SRC1 and the dummy driving stages SRCn+1 and SRCn+2 further receive a start signal STV.

According to the embodiment shown in FIG. 5, the plurality of driving stages SRC1 to SRCn are respectively connected to the plurality of gate lines GL1 to GLn. The plurality of driving stages SRC1 to SRCn respectively provide gate signals to the plurality of gate lines GL1 to GLn. However, the inventive concept is not limited thereto, and in some embodiments of the inventive concept, gate lines connected to the plurality of driving stages SRC1 to SRCn may be odd gate lines or even gate lines from among the gate lines GL1 to GLn.

Each of the plurality of driving stages SRC1 to SRCn and the dummy driving stages SRCn+1 and SRCn+2 includes input terminals IN1, IN2, and IN3, an output terminal OUT, a carry terminal CR, a clock terminal CK, a first voltage terminal V1, and a second voltage terminal V2.

The output terminal OUT of each of the plurality of driving stages SRC1 to SRCn is connected to a corresponding gate line from among the plurality of gate lines GL1 to GLn. Gate signals generated from the plurality of driving stages SRC1 to SRCn are provided to the plurality of gate lines GL1 to GLn through the output terminals OUT.

The carry terminal CR of each of the plurality of driving stages SRC1 to SRCn is electrically connected to the first input terminal IN1 of a next driving stage of a corresponding driving stage. Additionally, the carry terminal CR of each of the plurality of driving stages SRC2 to SRCn, except for the first driving stage SRC1, is connected to one or more previous driving stages of the corresponding driving stage. For example, the carry terminal CR of the k-th driving stage from among the driving stages SRC1 to SRCn is connected to the second input terminal IN2 of the (k−1)th driving stage, and to the third input terminal IN3 of the (k−2)th driving stage. The carry terminal CR of each of the plurality of driving stages SRC1 to SRCn and the dummy driving stages SRCn+1 and SRCn+2 outputs a carry signal.

The input terminal IN1 of each of the plurality of driving stages SRC2 to SRCn and dummy driving stages SRCn+1 and SRCn+2, except for the first driving stage SRC1, receives a carry signal of a previous driving stage of a corresponding driving stage. For example, the first input terminal IN1 of the k-th driving stage SRCk receives the carry signal of the (k−1)th driving stage SRCk−1. The first input terminal IN1 of the first driving stage SRC1 from among the plurality of driving stages SRC1 to SRCn receives a vertical start signal STV to start the drive of the gate driving circuit 100, instead of the carry signal of a previous driving stage.

The second input terminal IN2 of each of the plurality of driving stages SRC1 to SRCn receives a carry signal from the carry terminal CR of the next driving stage of a corresponding driving stage. The third input terminal IN3 of each of the plurality of driving stages SRC1 to SRCn receives a carry signal of a driving stage after the next driving stage (e.g., a second next driving stage) of a corresponding driving stage. For example, the second input terminal IN2 of the k-th driving stage SRCk receives a carry signal outputted from the carry terminal CR of the (k+1)th driving stage SRCk+1. The third input terminal IN3 of the k-th driving stage SRCk receives a carry signal outputted from the carry terminal CR of the (k+2)th driving stage SRCk+2.

According to another embodiment of the inventive concept, the second input terminal IN2 of each of the plurality of driving stages SRC1 to SRCn may be electrically connected to the output terminal OUT of the next driving stage of a corresponding driving stage. Additionally, the third input terminal IN3 of each of the plurality of driving stages SRC1 to SRCn may be electrically connected to the output terminal OUT of a driving stage after the next driving stage (e.g., a second next driving stage) of a corresponding driving stage.

The second input terminal IN2 of the driving stage (e.g., a last driving stage) SRCn disposed at the end of the plurality of driving stages SRC1 to SRCn receives a carry signal outputted from the carry terminal CR of the dummy stage (e.g., a first dummy stage) SRCn+1. The third input terminal IN3 of the last driving stage SRCn receives a carry signal outputted from the carry terminal CR of the dummy stage (e.g., a second or next dummy stage) SRCn+2.

The clock terminal CK of each of the plurality of driving stages SRC1 to SRCn receives one of the first clock signal CKV and the second clock signal CKVB. Each of the clock terminals CK of the odd driving stages (e.g., SRC1, SRC3, . . . , SRCn−1) from among the plurality of driving stages SRC1 to SRCn may receive the first clock signal CKV. Each of the clock terminals CK of the even driving stages (e.g., SRC2, SRC4, . . . , SRCn) from among the plurality of driving stages SRC1 to SRCn may receive the second clock signal CKVB. The first clock signal CKV and the second clock signal CKVB may have different phases.

The first voltage terminal V1 of each of the plurality of driving stages SRC1 to SRCn receives a first voltage (e.g., a first low or ground voltage) VSS1. The second voltage terminal V2 of each of the plurality of driving stages SRC1 to SRCn receives a second voltage (e.g., a second low or ground voltage) VSS2. The first voltage VSS1 and the second voltage VSS2 may have different voltage levels, and the second voltage VSS2 may have a lower voltage level than that of the first voltage VSS1.

According to an embodiment of the inventive concept each of the plurality of driving stages SRC1 to SRCn may omit one of the output terminal OUT, the first input terminal IN1, the second input terminal IN2, the third input terminal IN3, the carry terminal CR, the clock terminal CK, the first voltage terminal V1, and the second voltage terminal V2, or may further include other terminals, according to a circuit configuration. For example, one of the first voltage terminal V1 and the second voltage terminal V2 may be omitted. In this case, each of the plurality of driving stages SRC1 to SRCn receives only one of the first voltage VSS1 and the second voltage VSS2. Additionally, the connection relationships of the plurality of driving stages SRC1 to SRCn may be changed.

Figure 6:
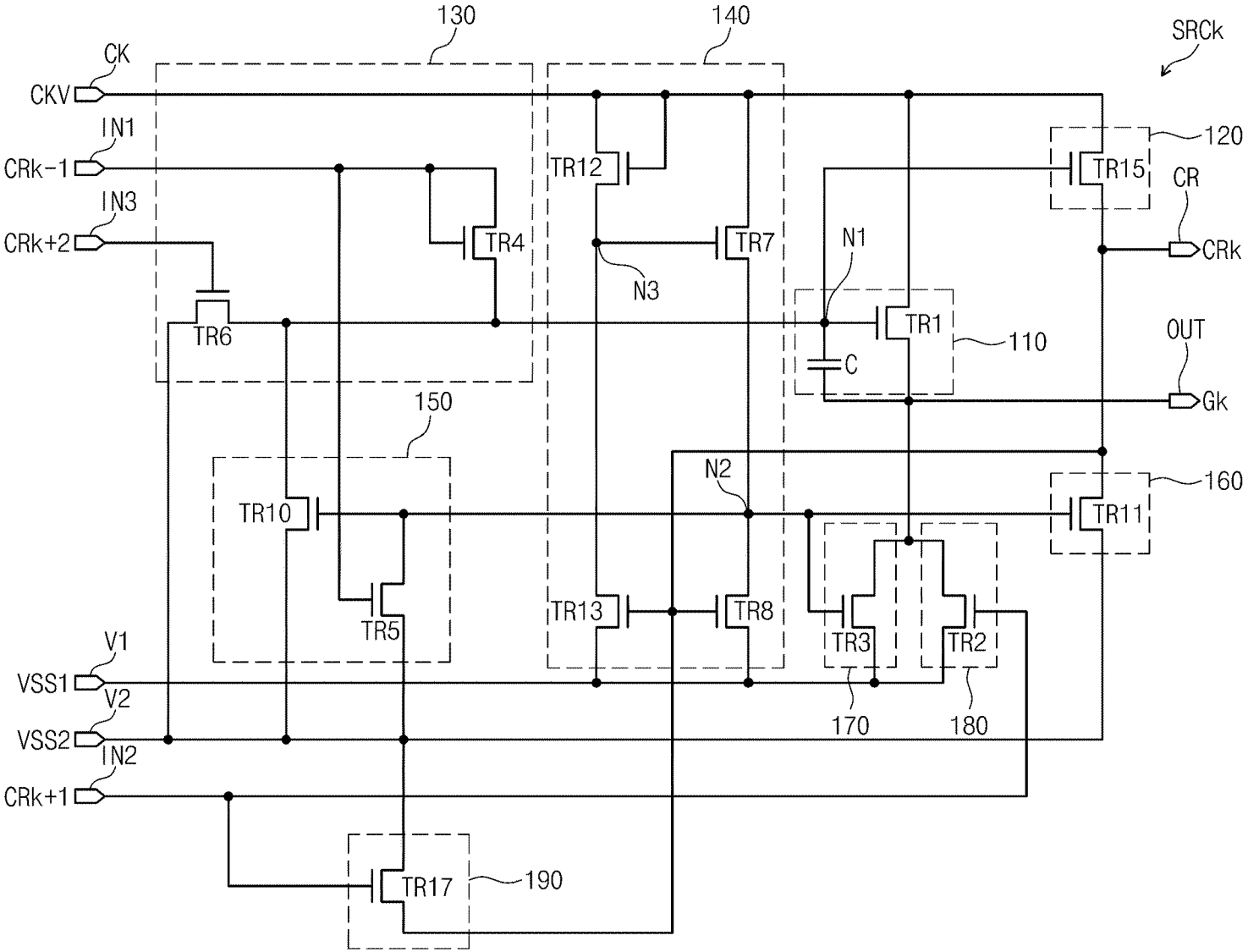
FIG. 6 is a circuit diagram of a driving stage according to an embodiment of the inventive concept.

FIG. 6 is a circuit diagram of a driving stage according to an embodiment of the inventive concept.

FIG. 6 illustrates the k-th driving stage SRCk (k being a natural number greater than or equal to 2) from among the plurality of driving stages SRC1 to SRCn shown in FIG. 5. Each of the plurality of driving stages SRC1 to SRCn shown in FIG. 5 may have the same or substantially the same circuit as that of the k-th driving stage SRCk.

Referring to FIG. 6, the k-th driving stage SRCk includes a first output unit 110, a second output unit 120, a control unit 130, an inverter unit 140, a first discharge unit 150, a second discharge unit 160, a third discharge unit 170, a first pull-down unit 180, and a second pull-down unit 190.

The first output unit 110 outputs the k-th gate signal Gk, and the second output unit 120 outputs the k-th carry signal CRk. The first pull-down unit 180, connected to the first voltage terminal V1, pulls down the output terminal OUT to the first voltage VSS1. The second pull-down unit 190, connected to the second voltage terminal V2, pulls down the carry terminal CR to the second voltage VSS2. The control unit 130 controls operations of the first output unit 110 and the second output unit 120.

In more detail, the first output unit 110 includes a first output transistor TR1 and a capacitor C. The first output transistor TR1 includes a first electrode connected to the clock terminal CK, a control electrode connected to a first node N1, and a second electrode connected to the output terminal OUT for outputting the k-th gate signal Gk.

The second output unit 120 includes a second output transistor TR15. The second output transistor TR15 includes a first electrode connected to the clock terminal CK, a control electrode connected to the first node N1, and a second electrode connected to the carry terminal CR for outputting the k-th carry signal CRk.

As shown in FIG. 5 above, each of the clock terminals CK of some driving stages SRC1, SRC3, . . . , SRCn−1 from among the plurality of driving stages SRC1 to SRCn, and the dummy driving stage SRCn+1 may receive the first clock signal CKV. Each of the clock terminals CK of other driving stages SRC2, SRC4, . . . , SRCs from among the plurality of driving stages SRC1 to SRCn, and the dummy driving stage SRCn+2 may receive the second clock signal CKVB. The first clock signal CKV and the second clock signal CKVB are complementary signals. That is, the first clock signal CKV and the second clock signal CKVB may have a phase difference of 180°.

The control unit 130 turns on the first output transistor TR1 and the second output transistor TR15 in response to the (k−1)th carry signal CRk−1 received through the first input terminal IN1 from a previous driving stage SRCk−1. The control unit 130 turns off the first output transistor TR1 and the second output transistor TR15 in response to the (k+2)th carry signal CRk+2 received through the third input terminal INT3 from the (k+2)th (e.g., the second next) driving stage SRCk+2.

The control unit 130 includes a fourth transistor TR4 and a sixth transistor TR6. The fourth transistor TR4 includes a first electrode connected to the first input terminal IN1, a second electrode connected to the first node N1, and a control electrode connected to the first input terminal IN1. The sixth transistor TR6 includes a first electrode connected to the first node N1, a second electrode connected to the second voltage terminal V2, and a control electrode connected to the third input terminal IN3.

The inverter unit 140 delivers a clock signal CKV (or CKVB) from a clock terminal CK to a second node N2. The inverter unit 140 includes transistors TR7, TR8, TR12, and TR13. The seventh transistor TR7 includes a first electrode connected to the clock terminal CK, a second electrode connected to the second node N2, and a control electrode connected to a third node N3. The twelfth transistor TR12 includes a first electrode connected to the clock terminal CK, a second electrode connected to the third node N3, and a control electrode connected to the clock terminal CK. The eighth transistor TR8 includes a first electrode connected to the second node N2, a second electrode connected to the first voltage terminal V1, and a control electrode connected to the carry terminal CR. The thirteenth transistor TR13 includes a first electrode connected to the third node N3, a second electrode connected to the first voltage terminal V1, and a control electrode connected to the carry terminal CR.

The first discharge unit 150 discharges the second node N2 to the second voltage terminal V2 in response to a signal of the first node N1, and discharges the first node N1 to the second voltage terminal V2 in response to a signal of the second node N2. The first discharge unit 150 includes a fifth transistor TR5 and a tenth transistor TR10. The fifth transistor TR5 includes a first electrode connected to the second node N2, a second electrode connected to the second voltage terminal V2, and a control electrode connected to the first input terminal IN1. The tenth transistor TR10 includes a first electrode connected to the first node N1, a second electrode connected to the second voltage terminal V2, and a control electrode connected to the second node N2.

The second discharge unit 160 discharges the carry terminal CR to the second voltage terminal V2 in response to a signal of the second node N2. The second discharge unit 160 includes an eleventh transistor TR11 including a first electrode connected to the carry terminal CR, a second electrode connected to the second voltage terminal V2, and a control electrode connected to the second node N2.

The third discharge unit 170 discharges the output terminal OUT to the first voltage terminal V1 in response to a signal of the second node N2. The third discharge unit 170 includes a third transistor TR3 including a first electrode connected to the output terminal OUT, a second electrode connected to the first voltage terminal V1, and a control electrode connected to the second node N2.

The first pull-down unit 180 discharges the output terminal OUT to the first voltage terminal V1 in response to the (k+1)th carry signal CRk+1 received through the second input terminal IN2. The first pull-down unit 180 includes a second transistor TR2 including a first electrode connected to the output terminal OUT, a second electrode connected to the first voltage terminal V1, and a control electrode connected to the second input terminal IN2.

The second pull-down unit 190 discharges the carry terminal CR to the second voltage terminal V2 in response to the (k+1)th carry signal CRk+1 received through the second input terminal IN2. The second pull-down unit 190 includes a seventeenth transistor TR17 including a first electrode connected to the carry terminal CR, a second electrode connected to the second voltage terminal V2, and a control electrode connected to the second input terminal IN2.

Figure 7:
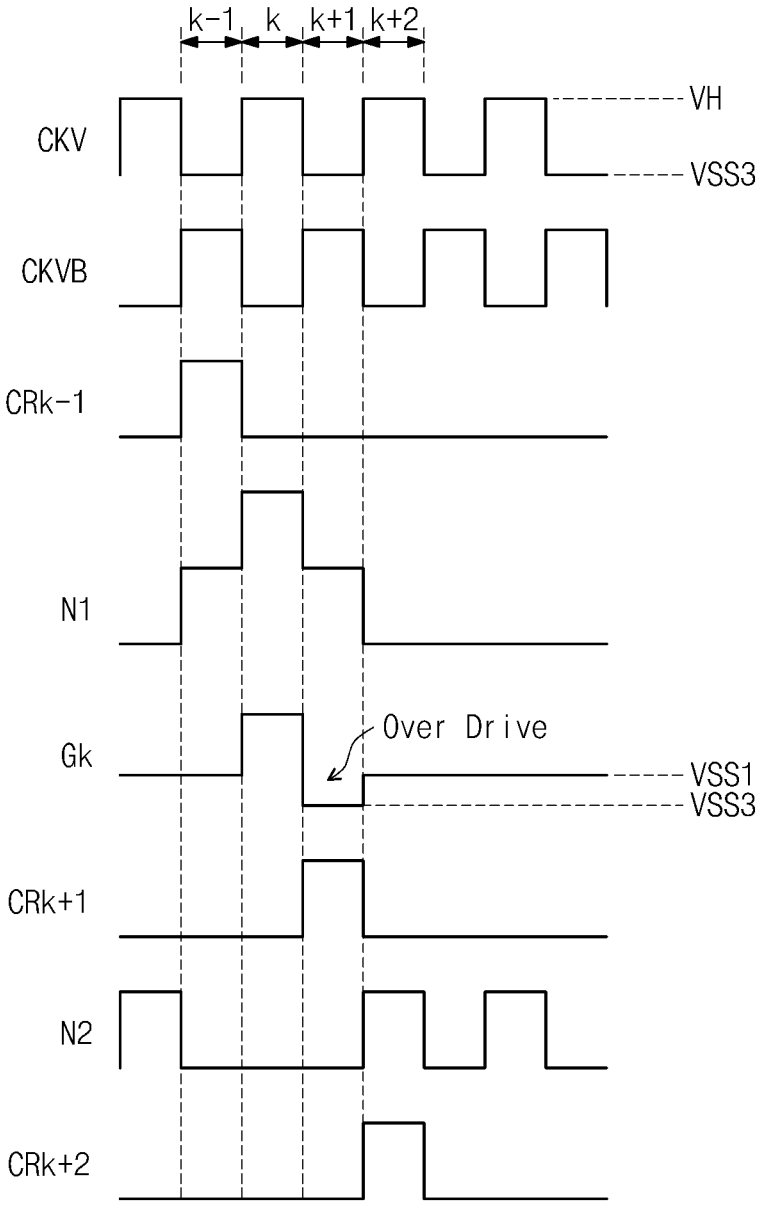
FIG. 7 is a timing diagram illustrating an operation of the k-th driving stage shown in FIG. 6.

FIG. 7 is a timing diagram illustrating an operation of the k-th driving stage shown in FIG. 6.

Referring to FIGS. 6 and 7, the first clock signal CKV and the second clock signal CKVB may have the same or substantially the same frequency and different phases. Each of the first clock signal CKV and the second clock signal CKVB is a pulse signal in which a high voltage VH and a third voltage (e.g., a third ground voltage or a third low voltage) VSS3 appear periodically. The third voltage VSS3 of the first clock signal CKV and the second clock signal CKVB has a lower voltage level than those of the first voltage VSS1 and the second voltage VSS2.

When the (k−1)th carry signal CRk−1 transitions to a high level during the (k−1)th clock period k−1, the transistor TR4 is turned on, so that a voltage level of the first node N1 rises. When the first clock signal CKV transitions to a level of a high voltage VH during the k-th clock period k, the first output transistor TR1 is turned on, so that a voltage of the first node N1 is boosted by the capacitor C. At this point, the k-th gate signal Gk is outputted through the output terminal OUT. When the second output transistor TR15 is turned on by the boosted voltage of the first node N1, the k-th carry signal CRk is outputted through the carry terminal CR.

When the first clock signal CKV transitions to a level of the third voltage VSS3 during the (k+1)th clock period k+1, the k-th gate signal Gk of the output terminal OUT may be discharged to a level of the third voltage VSS3 of the first clock signal CKV.

Then, when the (k+1)th carry signal CRk+1 transitions to a high level, the second transistor TR2 in the first pull-down unit 180 is turned on, so that the k-th gate signal Gk of the output terminal OUT is discharged as the first voltage VSS1. When the seventeenth transistor TR17 in the second pull-down unit 190 is turned on in response to the (k+1)th carry signal CRk+1 of a high level, the k-th carry signal CRk of the carry terminal CR is discharged as the second voltage VSS2.

Moreover, while the (k−1)th carry signal CRk−1 is in a high level (for example, during the (k−1)th clock period), the fifth transistor TR5 is turned on, so that the second node N2 maintains or substantially maintains a level of the second voltage VSS2. When the (k−1)th carry signal CRk−1 is in a low level, the k-th carry signal CRk is in a low level, and the first clock signal CKV is in a high level during the (k+2)th clock period, so that the second node N2 transitions to a high level. When the second node N2 is in a high level, the third transistor TR3 is turned on, so that the output terminal OUT may be maintained or substantially maintained with the first voltage VSS1. Similarly, when the second node N2 is in a high level, the eleventh transistor TR11 is turned on, so that the carry terminal CR may be maintained or substantially maintained with the second voltage VSS2.

Because the k-th gate signal Gk of the output terminal OUT is discharged as the third voltage VSS3 of the first clock signal CKV having a lower voltage level than that of the first voltage VSS1 during the (k+1)th clock period k+1, an additional transistor for discharging the k-th gate signal Gk of the output terminal OUT is not required. Therefore, a circuit area of each of the plurality of driving stages SRC1 to SRCn may be reduced. Furthermore, because the k-th gate signal Gk is discharged as the third voltage VSS3 having a lower voltage level than that of the first voltage VSS1, the discharge speed of the k-th gate signal Gk may be improved. Accordingly, even when a first horizontal period becomes longer as the size of the display panel DP shown in FIG. 1 becomes larger, gate signal delay may be minimized or reduced, thus, improving the reliability of the gate driving circuit 100.

Figure 8:
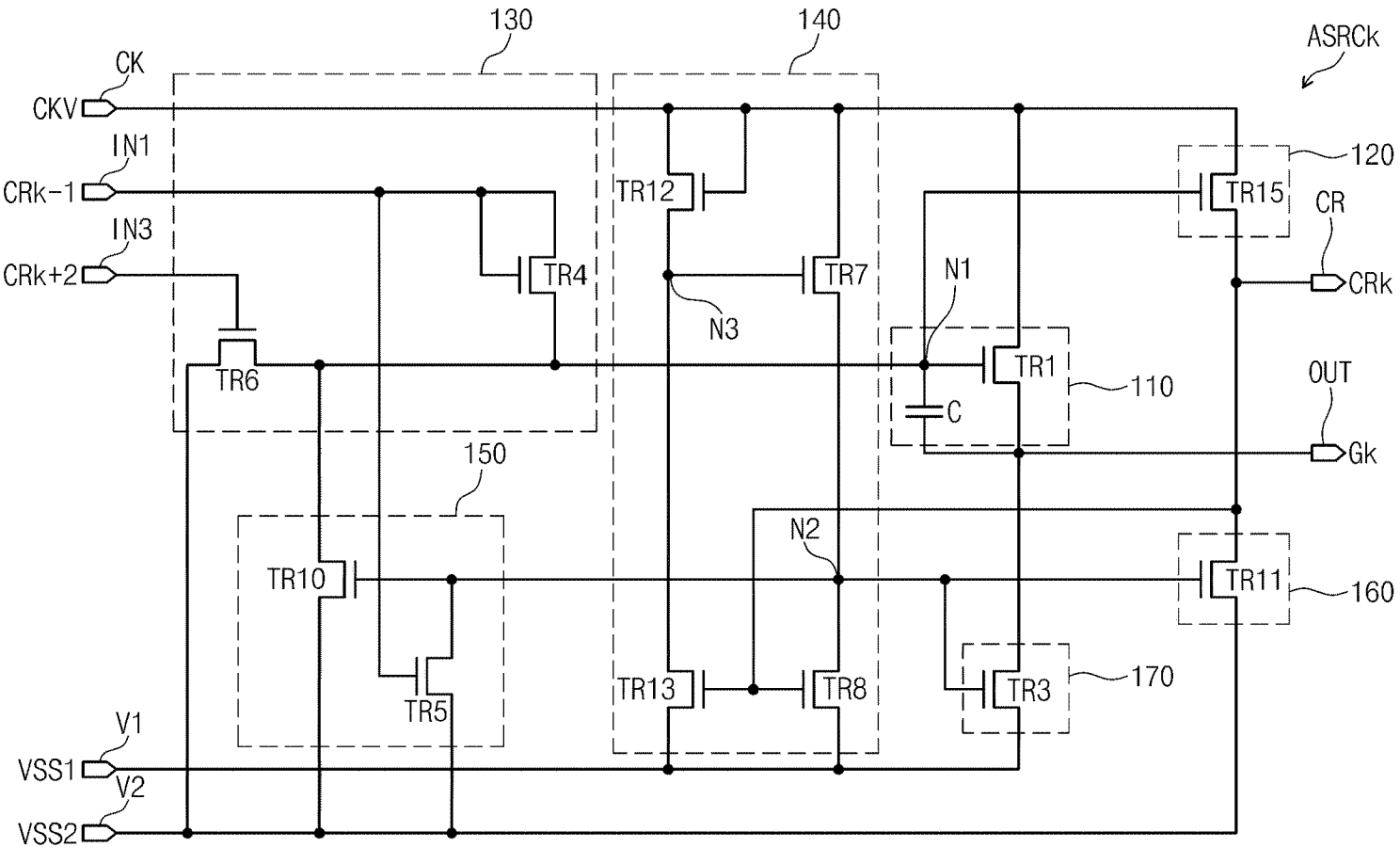
FIG. 8 is a circuit diagram of a driving stage according to another embodiment of the inventive concept.

FIG. 8 is a circuit diagram of a driving stage according to another embodiment of the inventive concept.

A driving stage ASRCk shown in FIG. 8 has a similar (e.g., a same or substantially the same) configuration as that of the driving stage SRCk shown in FIG. 6, except that the driving stage ASRCk does not include the first pull-down unit 180 and the second pull-down unit 190.

As described above with reference to FIG. 7, during the (k+1)th clock period k+1, the k-th clock signal Gk of the output terminal OUT may be discharged as the third voltage VSS3 of the first clock signal CKV. Accordingly, the first pull-down unit 180 for discharging the k-th clock signal Gk of the output terminal OUT as the first voltage VSS1 during the (k+1)th clock period k+1 may be omitted. Similarly, the k-th carry signal CRk of the carry terminal CR may be discharged as the third voltage VSS3 of the first clock signal CKV. Accordingly, the second pull-down unit 190 for discharging the k-th carry signal CRk of the carry terminal CR as the second voltage VSS2 during the (k+1)th clock period k+1 may be omitted.

The driving stage ASRCk shown in FIG. 8, where the first pull-down unit 180 and the second pull-down unit 190 shown in FIG. 6 are omitted, may have a more reduced circuit area than that of the driving stage SRCk shown in FIG. 6. Further, while the stage ASRCk in FIG. 8 is shown as including the fifth transistor TR5, the fifth transistor TR5 may also be omitted in order to further reduce a circuit area.

Figure 9:
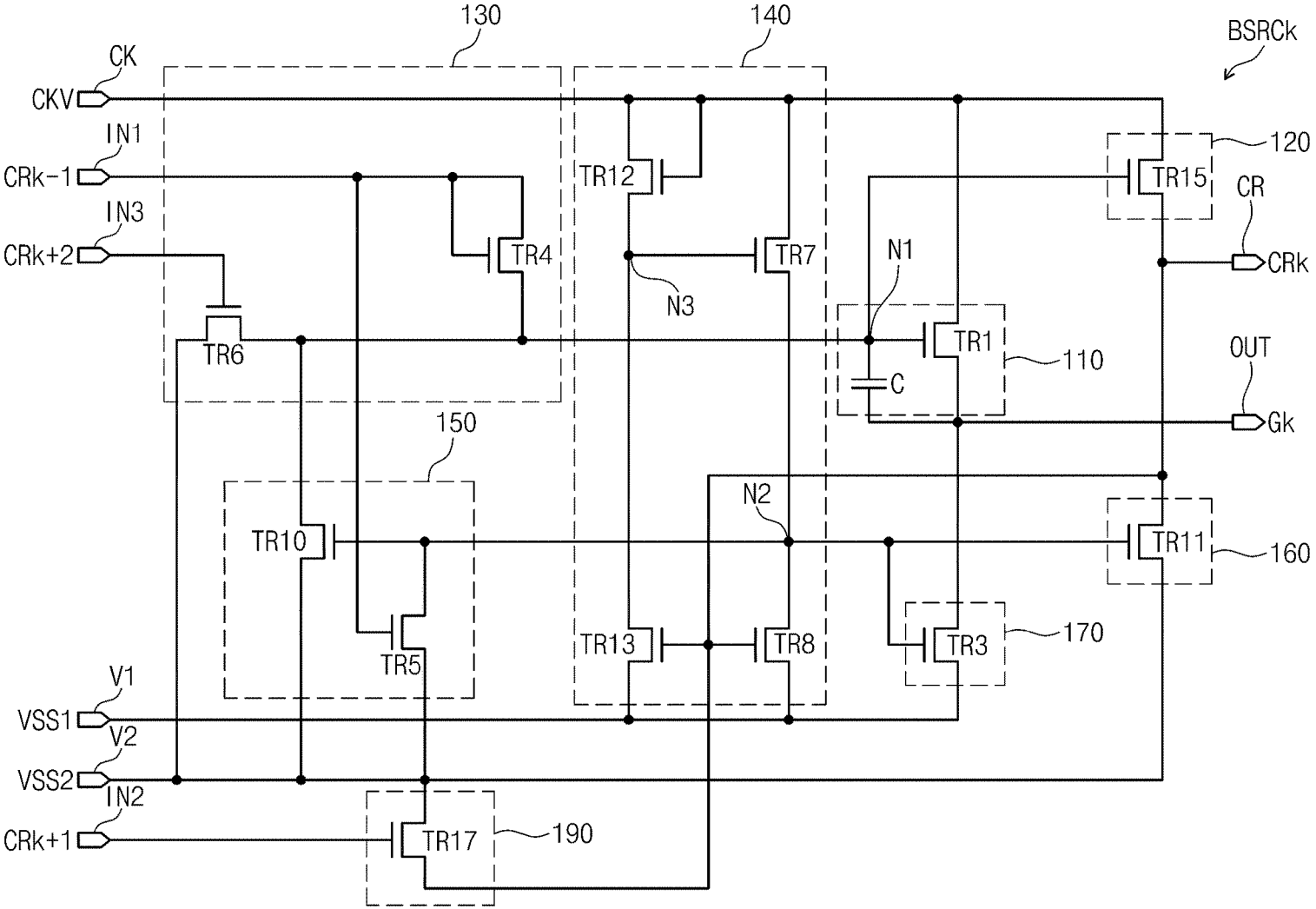
FIG. 9 is a circuit diagram of a driving stage according to another embodiment of the inventive concept.

FIG. 9 is a circuit diagram of a driving stage according to another embodiment of the inventive concept.

A driving stage BSRCk shown in FIG. 9 has a similar (e.g., a same or substantially the same) configuration as that of the driving stage SRCk shown in FIG. 6, except that the driving stage BSRCk does not include the first pull-down unit 180.

As described above with reference to FIG. 7, during the (k+1)th clock period k+1, the k-th clock signal Gk of the output terminal OUT may be discharged as the third voltage VSS3 of the first clock signal CKV. Accordingly, the first pull-down unit 180 for discharging the k-th clock signal Gk of the output terminal OUT as the first voltage VSS1 during the (k+1)th clock period k+1 may be omitted.

However, the driving stage BSRCk shown in FIG. 9 may further include the second pull-down unit 190 in order to more stabilize an off voltage level of the k-th carry signal CRk. The driving stage BSRCk shown in FIG. 9, where the first pull-down unit 180 shown in FIG. 6 is omitted, may have a more reduced circuit area than that of the driving stage SRCk shown in FIG. 6.

Figure 10:
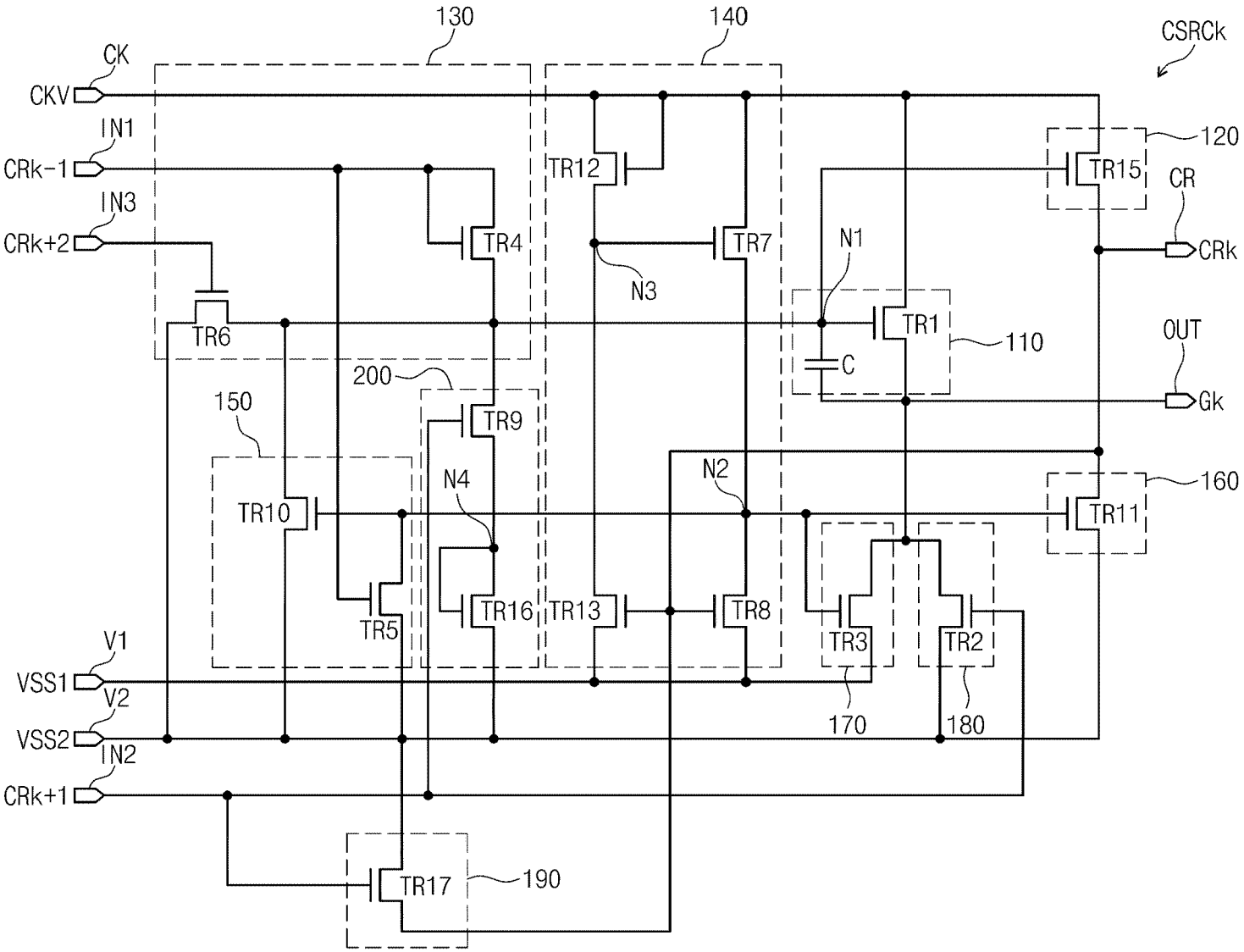
FIG. 10 is a circuit diagram of a driving stage according to another embodiment of the inventive concept.

FIG. 10 is a circuit diagram of a driving stage according to another embodiment of the inventive concept.

A driving stage CSRCk shown in FIG. 10 has a similar (e.g., a same or substantially the same) configuration as that of the driving stage SRCk shown in FIG. 6, except that the driving stage CSRCk further includes a third pull-down unit 200.

Referring to FIG. 10, the third pull-down unit 200 discharges the first node N1 to the second voltage VSS2 in response to the (k+1)th carry signal CRk+1. The third pull-down unit 200 includes a ninth transistor TR9 and a sixteenth transistor TR16. The ninth transistor TR9 includes a first electrode connected to the first node N1, a second electrode connected to the fourth node N4, and a control electrode connected to the second input terminal IN2. The sixteenth transistor TR16 includes a first electrode connected to the fourth node N4, a second electrode connected to the second voltage terminal V2, and a control electrode connected to the fourth node N4.

Figure 11:
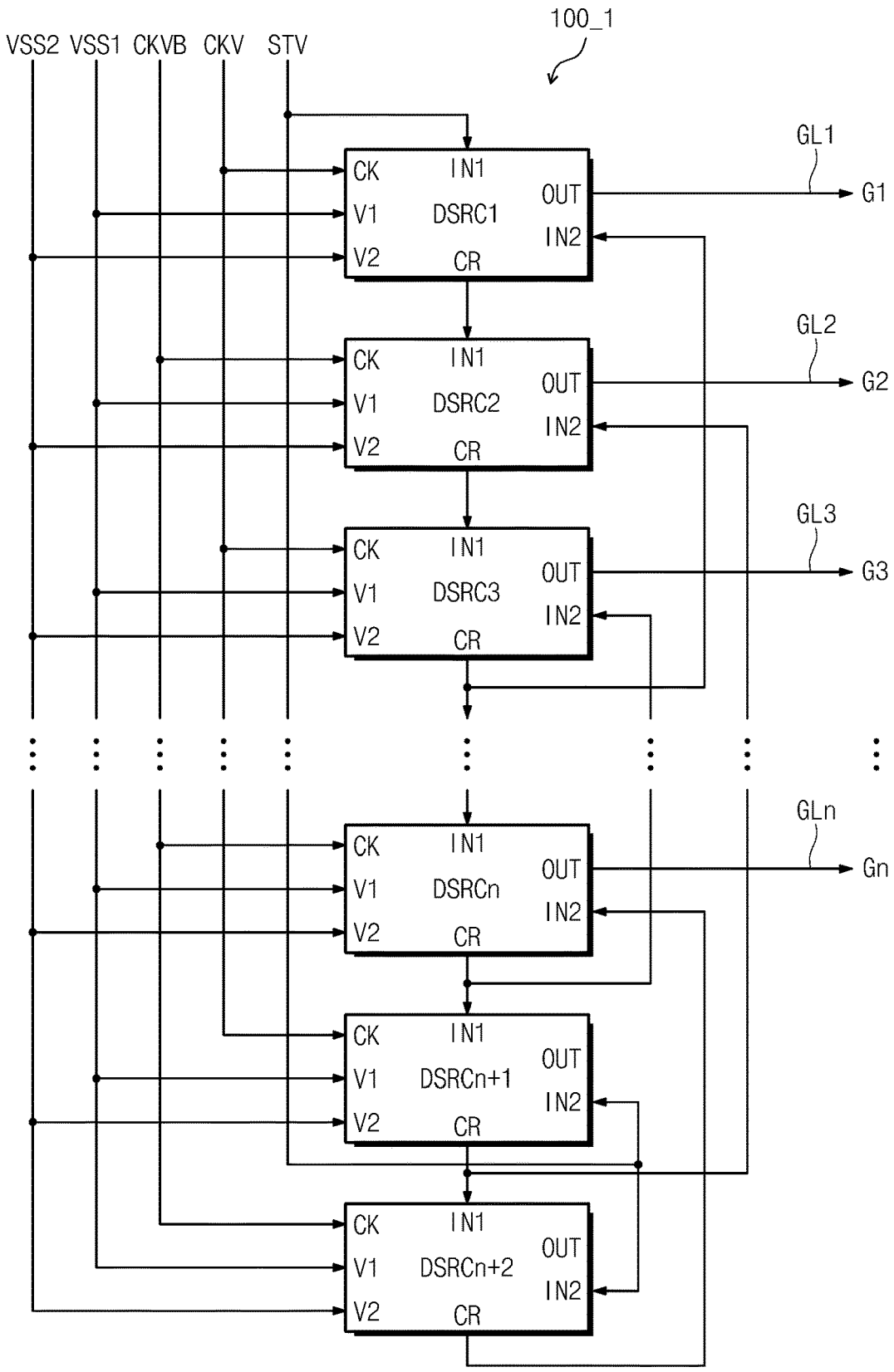
FIG. 11 is a block diagram illustrating a gate driving circuit according to another embodiment of the inventive concept.

FIG. 11 is a block diagram illustrating a gate driving circuit according to another embodiment of the inventive concept.

A gate driving circuit 100_1 shown in FIG. 11 has a similar (e.g., a same or substantially the same) configuration as that of the gate driving circuit 100 shown in FIG. 5, except that each of a plurality driving stages DSRC1 to DSRCn and dummy driving stages DSRCn+1 and DSRCn+2 does not include a third input terminal IN3.

The second input terminal IN2 of each of the plurality of driving stages SRC1 to SRCn receives a carry signal outputted from after a next driving stage (e.g., a second next driving stage) of a corresponding driving stage. For example, the second input terminal IN2 of the k-th driving stage DSRCk is electrically connected to the carry terminal CR of the (k+2)th driving stage DSRCk+2. The second input terminal IN2 of the dummy driving stages DSRCn+1 and DSRCn+2 receives a vertical start signal STV.

Figure 12:
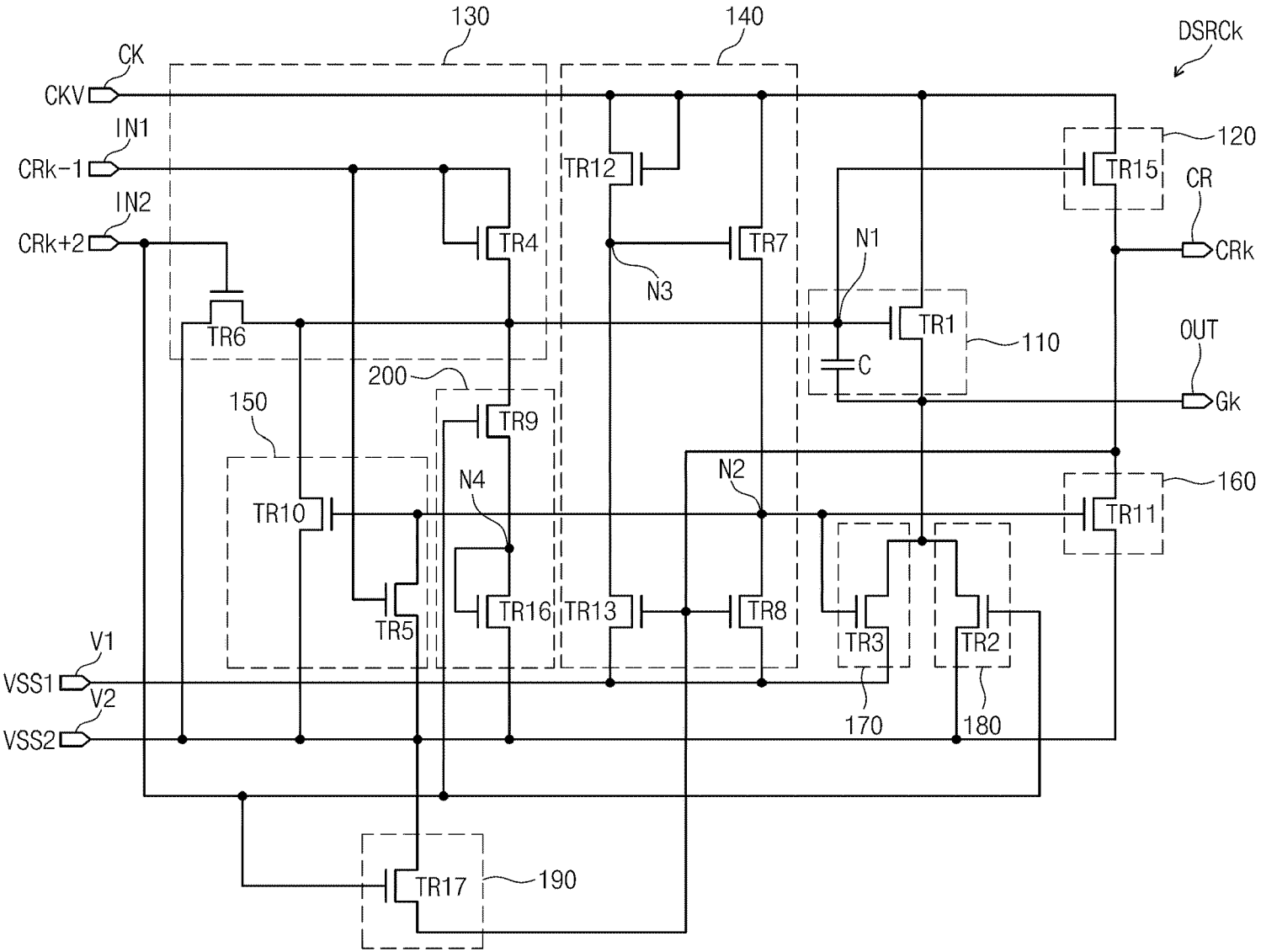
FIG. 12 is a circuit diagram of a driving stage shown in FIG. 11.

FIG. 12 is a circuit diagram of a driving stage shown in FIG. 11.

A driving stage DSRCk shown in FIG. 12 has a similar (e.g., a same or substantially the same) configuration as that of the driving stage CSRCk shown in FIG. 10, except that the first pull-down unit 180 and the second pull-down unit 190 operate in response to the (k+2)th carry signal CRk+2 input to the second input terminal IN2.

Because the driving stage DSRCk does not include an input terminal for receiving the (k+1)th carry signal CRk+1 and a signal line where the (k+1)th carry signal CRk+1 is transmitted, the circuit area of the gate driving circuit 100_1 shown in FIG. 11 may be reduced.

Figure 13:
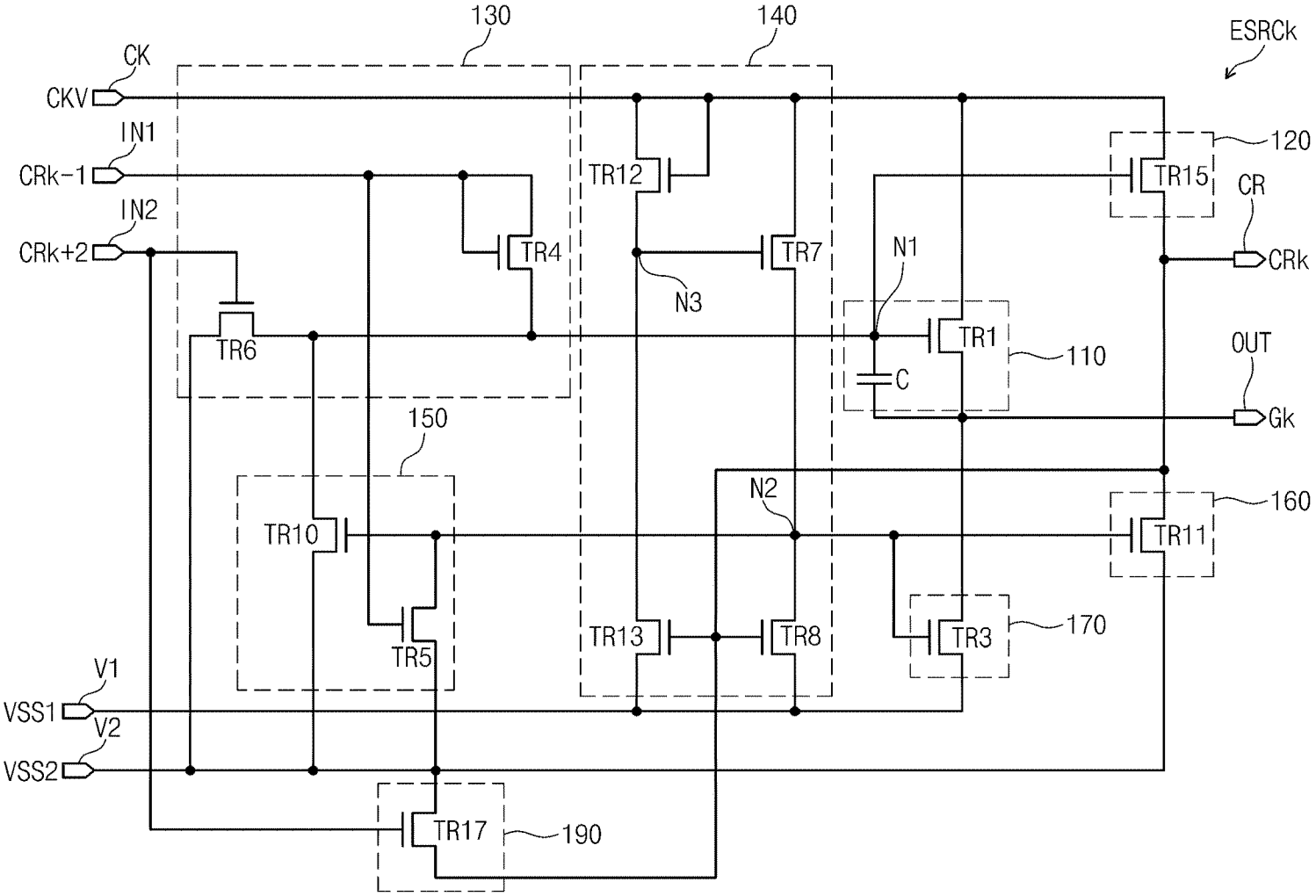
FIG. 13 is a circuit diagram of a driving stage according to another embodiment of the inventive concept.

FIG. 13 is a circuit diagram of a driving stage according to another embodiment of the inventive concept.

A driving stage ESRCk shown in FIG. 13 has a similar (e.g., a same or substantially the same) configuration as that of the driving stage DSRCk shown in FIG. 12, except that the driving stage ESRCk does not include the first pull-down unit 180 and the third pull-down unit 200.

As described above with reference to FIG. 7, during the (k+1)th clock period k+1, the k-th clock signal Gk of the output terminal OUT may be discharged as the third voltage VSS3 of the first clock signal CKV. Accordingly, the first pull-down unit 180 for discharging the k-th clock signal Gk of the output terminal OUT as the first voltage VSS1 during the (k+1)th clock period k+1 may be omitted.

Because the driving stage ESRCk does not include the first pull-down unit 180 shown in FIG. 12, its circuit area may be further reduced than that of the driving stage DSRCk shown in FIG. 12.

Figure 14:
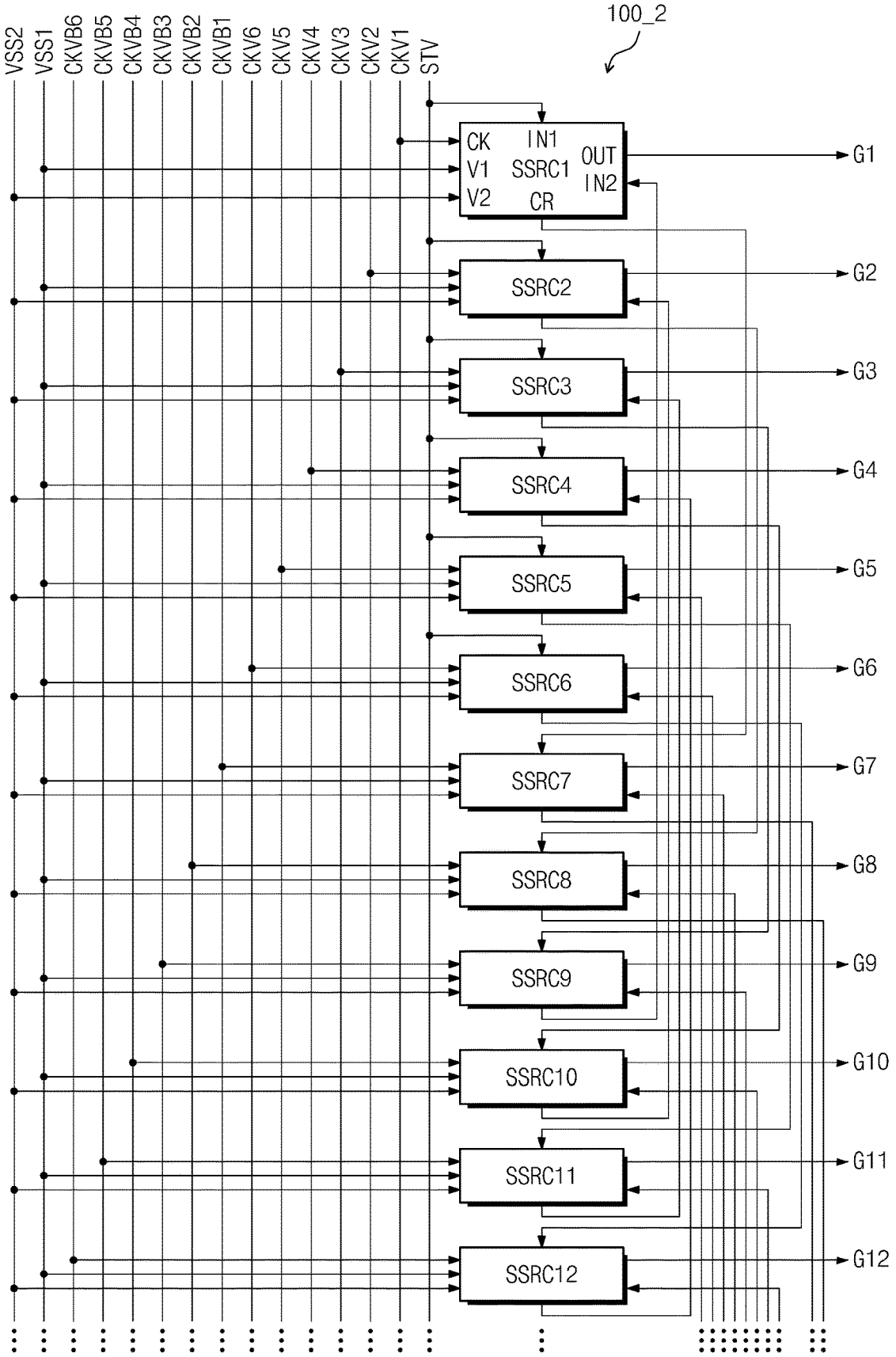
FIG. 14 is a block diagram illustrating a gate driving circuit according to another embodiment of the inventive concept.

FIG. 14 is a block diagram illustrating a gate driving circuit according to another embodiment of the inventive concept.

A gate driving circuit 100_2 shown in FIG. 14 includes a plurality of driving stages SSRC1 to SSRCn and a plurality of dummy driving stages. The plurality of driving stages SSRC1 to SSRCn and dummy driving stages have a cascade relationship in which they operate in response to a carry signal outputted from a previous stage and a carry signal outputted from a next stage.

Each of the plurality of driving stages SSRC1 to SSRCn receives one of first clock signals CKV1 to CKV6 and second clock signals CKVB1 to CKVB6 from the driving controller 300 shown in FIG. 1, and further receives the first voltage VSS1 and the second voltage VSS2. The driving stages SSRC1 to SSRC6 may further receive a start signal STV.

Each of the plurality of driving stages SSRC1 to SSRCn and the dummy driving stages includes input terminals IN1 and IN2, an output terminal OUT, a carry terminal CR, a clock terminal CK, a first voltage terminal (e.g., a first ground terminal) V1, and a second voltage terminal (e.g., a second ground terminal) V2.

Figure 15:
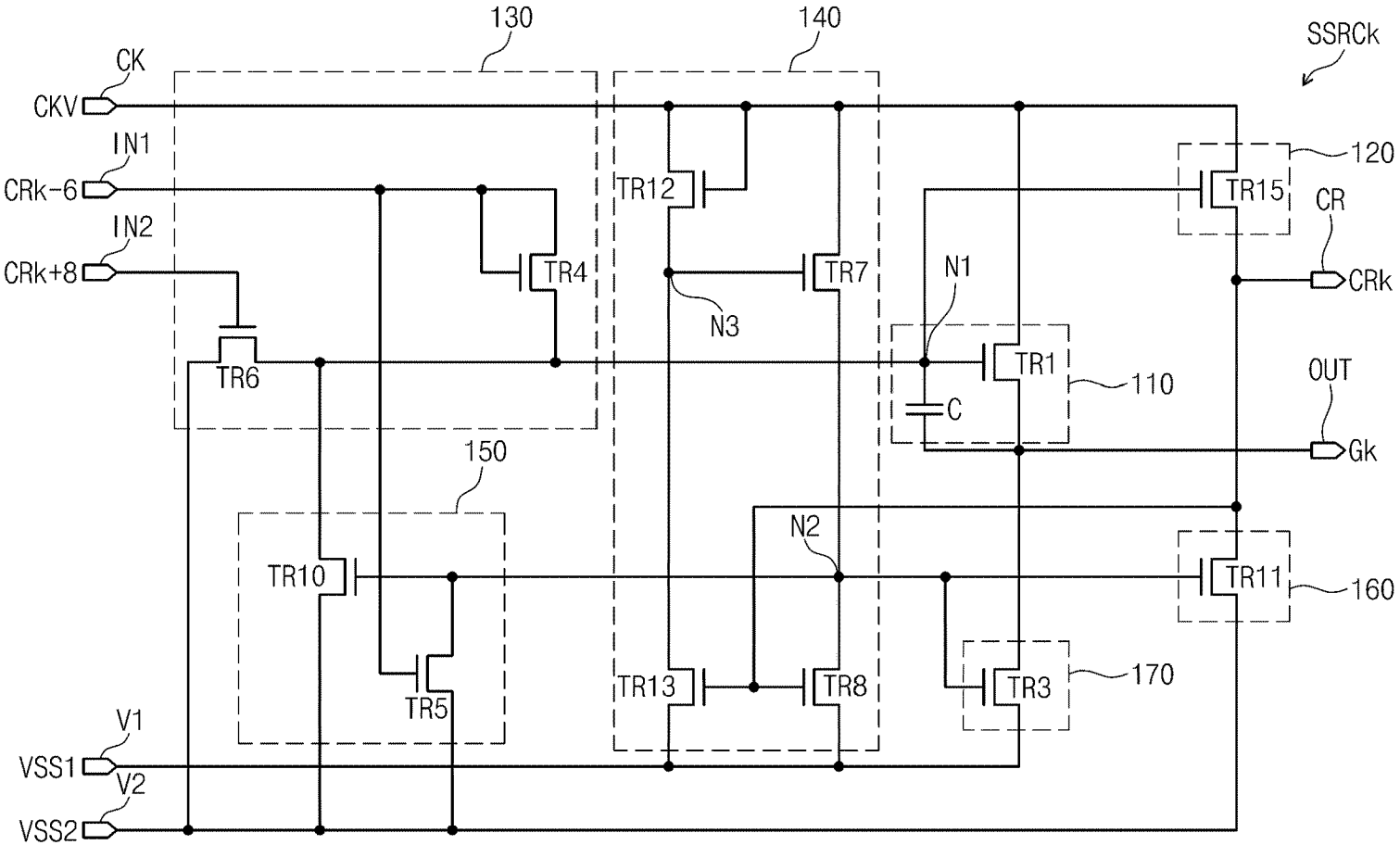
FIG. 15 is a circuit diagram of a driving stage shown in FIG. 14.

FIG. 15 is a circuit diagram of a driving stage shown in FIG. 14.

A driving stage SSRCk shown in FIG. 15 has a similar (e.g., a same or substantially the same) configuration as that of the driving stage ASRCk shown in FIG. 8, except that the first input terminal IN1 receives the (k−6)th carry signal CRk−6, and the second input terminal IN2 receives the (k+8)th carry signal CRk+8 instead of a third input terminal IN3 receiving the (k+2)th carry signal CRk+2.

Because the driving stage SSRCk does not include an input terminal for receiving the (k+1)th carry signal CRk+1 and a signal line where the (k+1)th carry signal CRk+1 is transmitted when compared to the driving stage SRCk shown in FIG. 6, the circuit area of the gate driving circuit 100_2 shown in FIG. 14 may be reduced.

Figure 16:
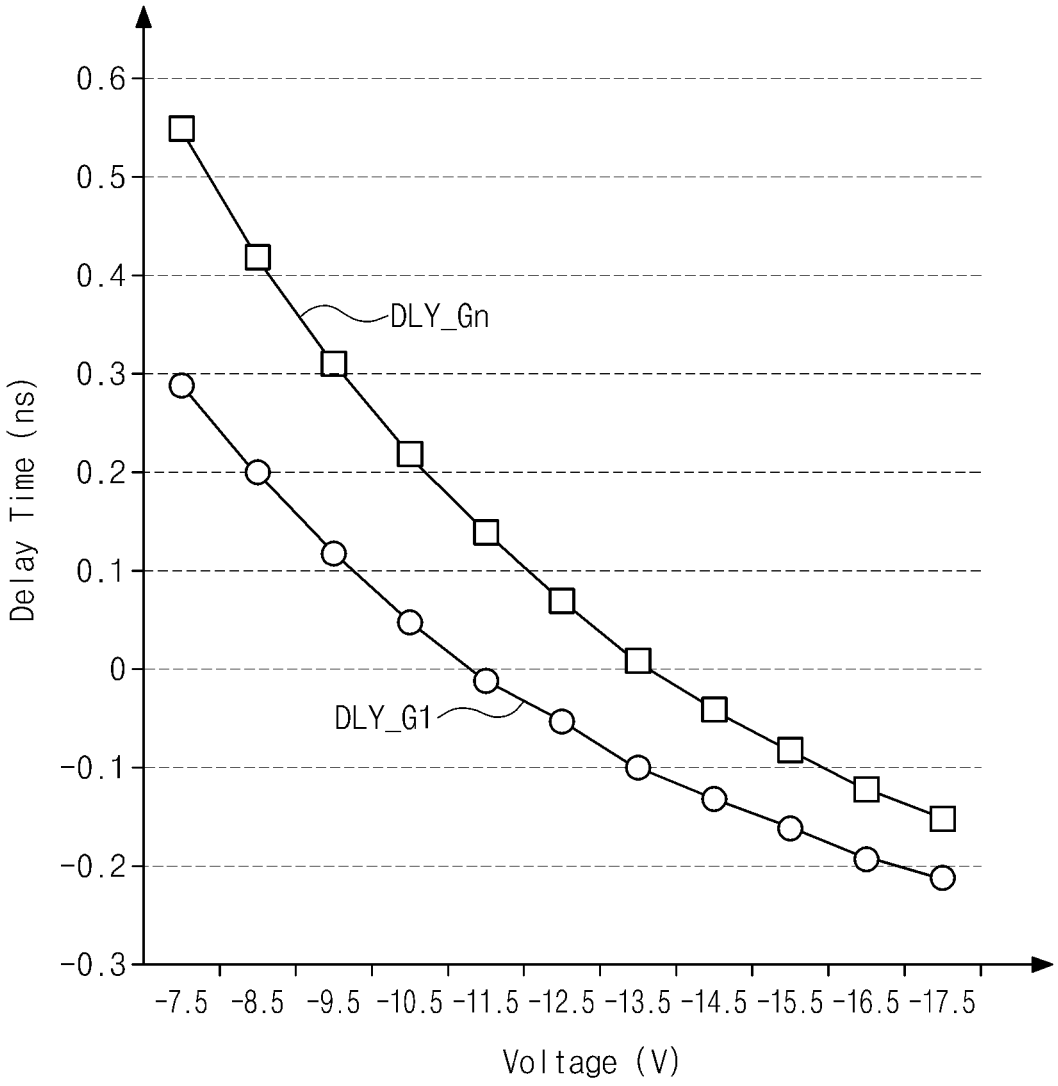
FIG. 16 is a graph illustrating a delay time of gate signals outputted from a gate driving circuit shown in FIG. 1.

FIG. 16 is a graph illustrating a delay time of gate signals outputted from a gate driving circuit shown in FIG. 1.

Referring to FIGS. 1 and 16, the gate driving circuit 100 generates gate signals G1 to Gn based on a vertical synch signal STV, a first clock signal CKV, and a second clock signal CKVB, which are received from the driving controller 300 through a signal line GSL.

When a voltage level of a low level of each of the first clock signal CKV and the second clock signal CKVB is the same or substantially the same, it is shown that a delay curve DLY_G1 of a gate signal G1 and a delay curve DLY_Gn of a gate signal Gn are different from each other. That is, the gate signal Gn provided to the nth gate line GLn away (e.g., farther away) from the driving controller 300 has a longer delay time than the gate signal G1 provided to the first gate line GL1 closer (e.g., adjacent) to the driving controller 300. This is due to a delay time and a voltage level of the first clock signal CKV and the second clock signal CKVB provided from the driving controller 300 shown in FIG. 1 to the gate driving circuit 100.

For example, when a voltage level of a low level of each of the first clock signal CKV and the second clock signal CKVB is about −11.5 V, a delay time of the gate signal G1 provided to the first gate line GL1 is about 0 ns and a delay time of the gate signal Gn provided to the nth gate line GLn is about 0.15 ns. That is, when a voltage level of each of the first clock signal CKV and the second clock signal CKVB is the same or substantially the same, a delay time of the gate signal Gn provided to the nth gate line GLn is longer.

Figure 17:
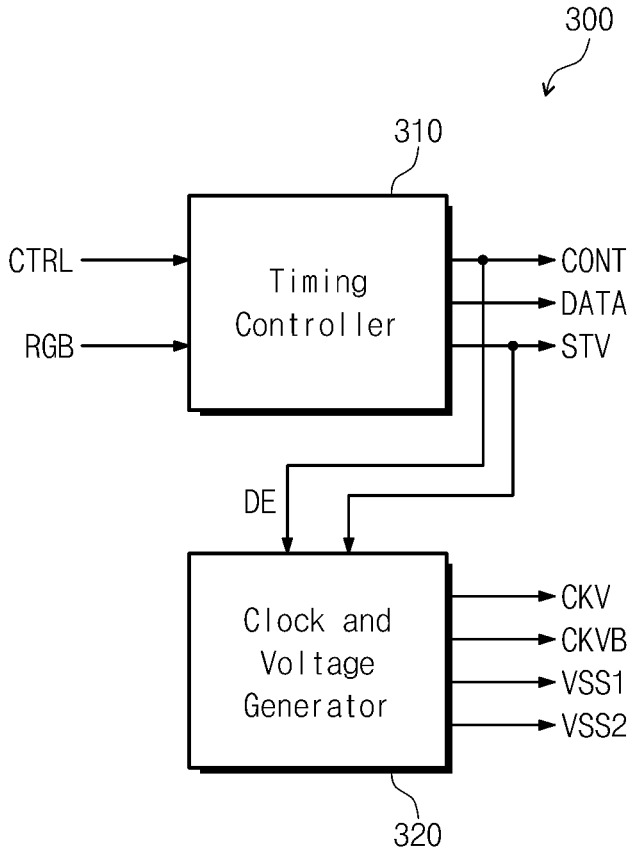
FIG. 17 is a block diagram illustrating a configuration of a driving controller shown in FIG. 1.

FIG. 17 is a block diagram illustrating a configuration of a driving controller shown in FIG. 1.

Referring to FIG. 17, the driving controller 300 includes a timing controller 310 and a clock and voltage generator 320. The timing controller 310 receives image data RGB and a control signal CTRL, and outputs a data control signal CONT to be provided to the data driving circuit 200 and a start signal STV to be provided to the gate driving circuit 100 (e.g., see FIG. 1). The data control signal CONT may include a data enable signal DE.

The clock and voltage generator 320 receives the start signal STV from the timing controller 310 and the data enable signal DE included in the data control signal CONT, and generates a first clock signal CKV, a second clock signal CKVB, a first voltage (e.g., a first ground voltage) VSS1, and a second voltage (e.g., a second ground voltage) VSS2. The first voltage VSS1 and the second voltage VSS2 generated by the clock and voltage generator 320 may have different voltage levels. The clock and voltage generator 320 may be configured with a power management integrated circuit (PMIC), and may be mounted on the main circuit board MCB shown in FIG. 1.

The clock and voltage generator 320 may change a voltage level of a low level of each of the first clock signal CKV and the second clock signal CKVB in response to the start signal STV and the data enable signal DE from the timing controller 310. That is, the clock and voltage generator 320 may change a voltage level of a low level of each of the first clock signal CKV and the second clock signal CKVB according to positions of the gate lines GL1 to GLn.

Figure 18:
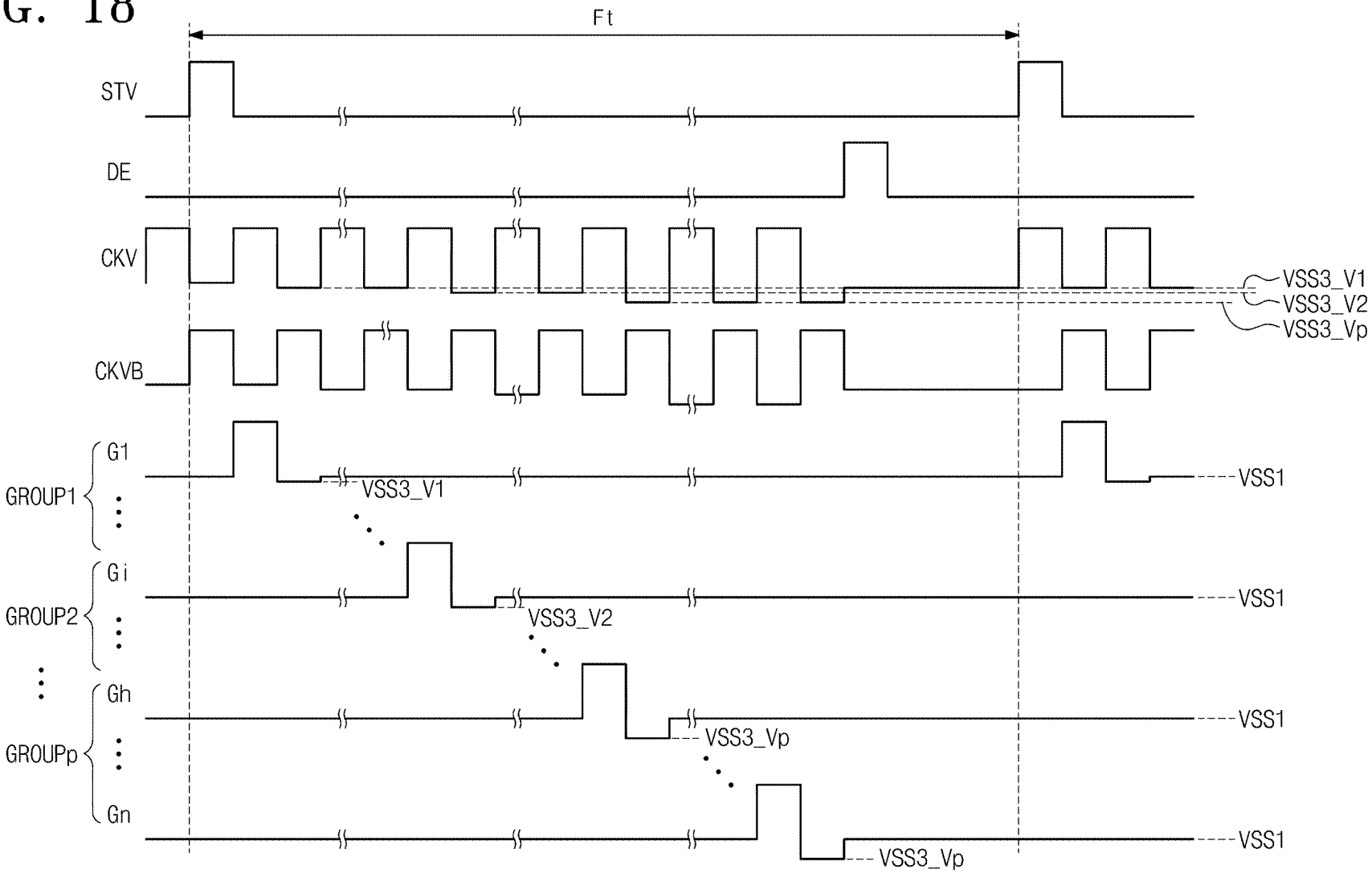
FIG. 18 is a timing diagram illustrating clock signals generated from a clock and voltage generator shown in FIG. 17, and gate signals generated from a gate driving circuit shown in FIG. 5.

FIG. 18 is a timing diagram illustrating clock signals generated from a clock and voltage generator shown in FIG. 17, and gate signals generated from a gate driving circuit shown in FIG. 5.

Referring to FIGS. 5, 17, and 18, the clock and voltage generator 320 starts to generate the first clock signal CKV and the second clock signal CKVB in response to the start signal STV. The clock and voltage generator 320 counts the number of pulses of the first clock signal CKV, and changes a voltage level of the third voltage VSS3 of each of the first clock signal CKV and the second clock signal CKVB according to a pulse count value during one frame Ft. For example, the gate lines GL1 to GLn may be divided into p groups. The clock and voltage generator 320 may set the third voltage VSS3 of each of the first clock signal CKV and the second clock signal CKVB corresponding to the gate lines GL1 to GLi−1 of the first group to VSS3_V1. The clock and voltage generator 320 may set the third voltage VSS3 of each of the first clock signal CKV and the second clock signal CKVB corresponding to the gate lines GLi to GLh−1 of the second group to VSS3_V2. The clock and voltage generator 320 may set the third voltage VSS3 of each of the first clock signal CKV and the second clock signal CKVB corresponding to the gate lines GLh to GLn of the last P group to VSS3_Vp.

The third voltage VSS3 of the first clock signal CKV and the second clock signal CKVB has a relationship of VSS3_V1>VSS3_V2> . . . >VSS3_Vp. As a result, the gate signal Gn provided to the nth gate line GLn farther away from the driving controller 300 has a more improved discharge speed than that of the gate signal G1 provided to the first gate line GL1 closer (e.g., adjacent) to the driving controller 300. Accordingly, even when a delay variation of the gate signals G1 to Gn according to the positions of the gate lines GL1 to GLn becomes greater as the size of the display panel DP shown in FIG. 1 becomes larger, the delay may be compensated for.

According to another embodiment of the inventive concept, the main circuit board MCB and the diving controller 300 shown in FIG. 1 are arranged closer (e.g., adjacent) to the last gate line GLn, and voltages corresponding to a low level of the first clock signal CKV and the second clock signal CKVB shown in FIG. 18 may have a relationship of VSS3_V1<VSS3_V2< . . . <VSS3_Vp.

Figure 19:
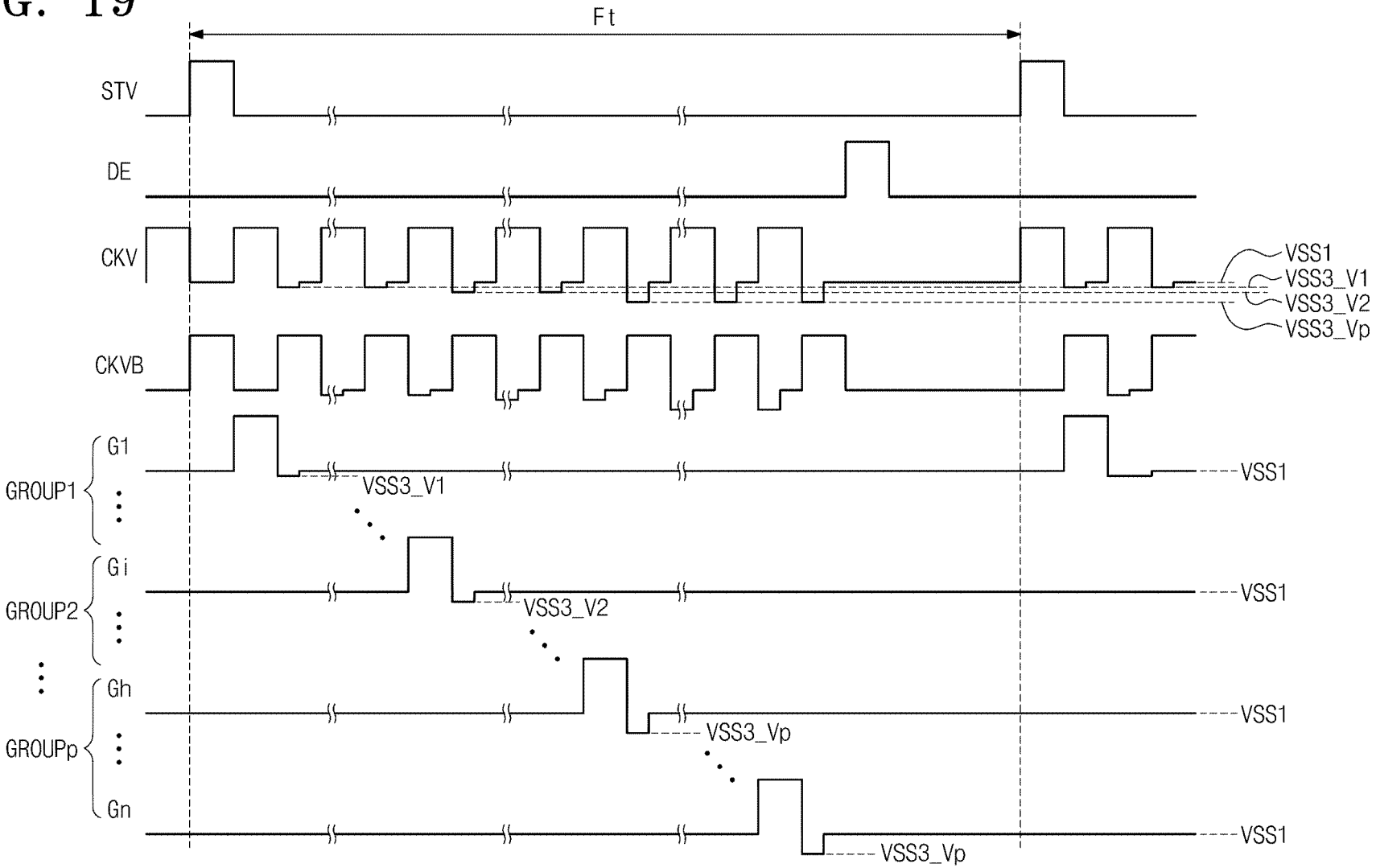
FIG. 19 is a timing diagram illustrating clock signals generated from a clock and voltage generator shown in FIG. 17, and gate signals generated from a gate driving circuit shown in FIG. 5, according to another embodiment of the inventive concept.

FIG. 19 is a timing diagram illustrating clock signals generated from a clock and voltage generator shown in FIG. 17, and gate signals generated from a gate driving circuit shown in FIG. 5, according to another embodiment of the inventive concept.

In the timing diagram shown in FIG. 18, a low level section of the first clock signal CKV and the second clock signal CKVB is maintained or substantially maintained at a set or predetermined voltage VSS3_V1, VSS3_V2, and VSS3_Vp. As shown in FIG. 19, during a low level section of the first clock signal CKV and the second clock signal CKVB, the set or predetermined voltage VSS3_V1, VSS3_V2, and VSS3_Vp changes into the first voltage VSS1.

Voltages corresponding to a low level of the first clock signal CKV and the second clock signal CKVB have a relationship of VSS3_V1>VSS3_V2> . . . >VSS3_Vp. As a result, the gate signal Gn provided to the nth gate line GLn farther away from the driving controller 300 has a more improved discharge speed than that of the gate signal G1 provided to the first gate line GL1 closer (e.g., adjacent) to the driving controller 300. Accordingly, even when a delay variation of the gate signals G1 to Gn according to positions of the gate lines GL1 to GLn becomes greater as the size of the display panel DP shown in FIG. 1 becomes larger, the delay may be compensated for.

In relation to a gate driving circuit having such a configuration, a gate signal may be discharged faster by changing a voltage level of a clock signal. Accordingly, the reliability of a gate driving circuit may be improved. Additionally, without using some of the transistors that discharge a first node (e.g., a potential of the first node), a gate signal, and a carry signal, a gate driving circuit may perform a stable or substantially stable operation. Accordingly, the circuit area of a gate driving circuit may be reduced.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is understood that the present invention should not be limited to these exemplary embodiments, and that various changes and modifications may be made by one having ordinary skill in the art, without departing from the spirit and scope of the present invention as defined in the following claims and their equivalents.

What is claimed is:

1. A gate driving circuit comprising:

a plurality of stages configured to provide gate signals to a plurality of gate lines of a display panel, a k-th stage, where k is a natural number greater than or equal to 2, from among the plurality of stages comprises:

a control circuit configured to deliver a (k-a)th carry signal from a (k-a)th stage to a first node in response to the (k-a)th carry signal, and discharge at the first node a second voltage in response to a (k+b)th carry signal from a (k+b)th stage, where a and b are natural numbers;

an output circuit configured to output a clock signal as a k-th gate signal and a k-th carry signal respectively, in response to a first signal of the first node; and a discharge circuit configured to discharge the k-th gate signal as a first voltage and discharge the k-th carry signal as the second voltage in response to a second signal generated based on the clock signal, wherein the clock signal is a pulse signal in which a high voltage and a low voltage appear periodically; and wherein the output circuit is configured to:

output the high voltage of the clock signal as the k-th gate signal in response to a first signal of the first node during a k-th period of the clock signal;

discharge the k-th gate signal as the low voltage of the clock signal in response to the first signal of the first node during a (k+1)th period of the clock signal; and discharge the k-th gate signal as the first voltage in response to the clock signal during a (k+2)th period of the clock signal.

2. The gate driving circuit of claim 1, wherein the output circuit comprises a first output unit configured to output the clock signal as the k-th carry signal in response to the first signal of the first node.

3. The gate driving circuit of claim 2, wherein the output circuit further comprises a second output unit configured to output the clock signal as the k-th carry signal in response to the first signal of the first node.

4. The gate driving circuit of claim 1, wherein the discharge circuit comprises a first pull-down unit configured to discharge the k-th gate signal as the first voltage in response to the second signal.

5. The gate driving circuit of claim 4, wherein the discharge circuit further comprises a second pull-down unit configured to discharge the k-th carry signal as the second voltage in response to the second signal.

6. The gate driving circuit of claim 1, wherein control circuit comprises a first control transistor comprising a first electrode connected to a first input terminal, a second electrode connected to the first node, and a control electrode connected to the first input terminal, wherein the first input terminal is configured to receive the (k-a)th carry signal from the (k-a)th stage.

7. The gate driving circuit of claim 1, wherein control circuit comprises a second control transistor comprising a first electrode connected to the first node, a second electrode connected to a second voltage terminal, and a control electrode connected to a second input terminal, wherein the second input terminal is configured to receive the (k+b)th carry signal from the (k+b)th stage, and wherein the second voltage terminal is configured to receive the second voltage.

8. The gate driving circuit of claim 1, wherein the k-th stage further comprises:

an inverter unit configured to receive the clock signal and output the second signal.

9. The gate driving circuit of claim 8, wherein the k-th stage further comprises:

a fourth discharge unit configured to discharge at the first node the second voltage in response to the (k+2)th carry signal; and a first pull-down unit configured to discharge the k-th gate signal as the second voltage in response to the (k+2)th carry signal.

10. A display device comprising:

a display panel comprising a plurality of pixels respectively connected to a plurality of gate lines and a plurality of data lines;

a gate driving circuit comprising a plurality of stages configured to output gate signals to the plurality of gate lines; and a data driving circuit configured to drive the plurality of data lines, wherein a k-th stage, where k is a natural number greater than or equal to 2, from among the plurality of stages comprises:

a control circuit configured to deliver a (k-a)th carry signal from a (k-a)th stage to a first node in response to the (k-a)th carry signal, and discharge at the first node a second voltage in response to a (k+b)th carry signal from a (k+b)th stage, where a and b are natural numbers;

an output circuit configured to output a clock signal as a k-th gate signal and a k-th carry signal respectively, in response to a first signal of the first node; and a discharge circuit configured to discharge the k-th gate signal as a first voltage and discharge the k-th carry signal as the second voltage in response to a second signal generated based on the clock signal, wherein the clock signal is a pulse signal in which a high voltage and a low voltage appear periodically; and wherein the output circuit is configured to:

output the high voltage of the clock signal as the k-th gate signal in response to a first signal of the first node during a k-th period of the clock signal;

discharge the k-th gate signal as the low voltage of the clock signal in response to the first signal of the first node during a (k+1)th period of the clock signal; and discharge the k-th gate signal as the first voltage in response to the clock signal during a (k+2)th period of the clock signal.

11. The display device of claim 10, wherein the display panel comprises:

a display area where the plurality of pixels are arranged; and a non-display area adjacent to the display area, wherein the gate driving circuit is integrated in the non-display area.

12. The display device of claim 10, wherein the output circuit comprises a first output unit configured to output the clock signal as the k-th carry signal in response to the first signal of the first node.

13. The display device of claim 12, wherein the output circuit further comprises a second output unit configured to output the clock signal as the k-th carry signal in response to the first signal of the first node.

14. The display device of claim 10, wherein the discharge circuit comprises a first pull-down unit configured to discharge the k-th gate signal as the first voltage in response to the second signal.

15. The display device of claim 14, wherein the discharge circuit further comprises a second pull-down unit configured to discharge the k-th carry signal as the second voltage in response to the second signal.

16. The display device of claim 10, wherein the k-th stage further comprises an inverter unit configured to receive the clock signal and output the second signal.

17. The display device of claim 10, wherein control circuit comprises:

a first control transistor comprising a first electrode connected to a first input terminal, a second electrode connected to the first node, and a control electrode connected to the first input terminal; and a second control transistor comprising a first electrode connected to the first node, a second electrode connected to a second voltage terminal, and a control electrode connected to a second input terminal, wherein the first input terminal is configured to receive the (k-a)th carry signal from the (k-a)th stage, wherein the second input terminal is configured to receive the (k+b)th carry signal from the (k+b)th stage, and wherein the second voltage terminal is configured to receive the second voltage.

18. The display device of claim 10, further comprising a driving controller configured to control the gate driving circuit and the data driving circuit in response to a control signal and an image signal provided from outside, and to generate the clock signal, the first voltage, the second voltage, and the low voltage.

19. The display device of claim 18, wherein the driving controller is configured to count the order of pulses of the clock signal in one frame, and change a voltage level of the low voltage of the clock signal based on a pulse count value.

20. The display device of claim 19, wherein the gate signals are to be outputted sequentially in an order from a first stage from among the plurality of stages closer to the driving controller to a last stage from among the plurality of stages farther from the driving controller, and a voltage level of the low voltage of each of pulses of the clock signal is to be gradually lowered according to the pulse count value in the one frame.

* * * * *